US010197930B2

(12) United States Patent
Yamada et al.

(10) Patent No.: US 10,197,930 B2
(45) Date of Patent: Feb. 5, 2019

(54) ELECTROPHOTOGRAPHIC MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masaki Yamada, Mishima (JP); Takanori Kaihara, Susono (JP); Takashi Koyanagi, Mishima (JP); Sosuke Yamaguchi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 141 days.

(21) Appl. No.: 15/241,544

(22) Filed: Aug. 19, 2016

(65) Prior Publication Data

US 2017/0060007 A1 Mar. 2, 2017

(30) Foreign Application Priority Data

Aug. 31, 2015 (JP) ..... 2015-170584

(51) Int. Cl.
*G03G 5/10* (2006.01)
*G03G 15/02* (2006.01)
(Continued)

(52) U.S. Cl.
CPC ..... *G03G 5/107* (2013.01); *G03G 15/0233* (2013.01); *G03G 15/0818* (2013.01); *G03G 21/0017* (2013.01); *G03G 15/0812* (2013.01); *G03G 21/18* (2013.01); *G03G 21/1814* (2013.01)

(58) Field of Classification Search
CPC ..... G03G 5/107; G03G 15/0233; G03G 15/0818; G03G 21/0017
See application file for complete search history.

(56) References Cited

U.S. PATENT DOCUMENTS 7,797,833 B2 9/2010 Nakamura et al.
7,799,398 B2 9/2010 Nakamura et al.
(Continued)

FOREIGN PATENT DOCUMENTS

JP S57-005047 1/1985
JP 2004-331885 11/2004
(Continued)

OTHER PUBLICATIONS

Damodar M. Pai, et al., "Imaging Technology, 2. Copying and Nonimpact Printing Processes," Ullmann's Encyclopedia of Industrial Chemistry, vol. 18, 553-602, published online 2011.*
(Continued)

*Primary Examiner* — Nicholas E Hill
(74) *Attorney, Agent, or Firm* — Venable LLP

(57) ABSTRACT

Provided is an electrophotographic member which hardly undergoes deformation even when subjected to a load over a long period of time under a high-temperature and high-humidity environment and thus can stably form a high-quality electrophotographic image. The electrophotographic member includes: an electroconductive substrate; and an electroconductive resin layer on the substrate, in which the resin layer contains a cation having a specific structure and a specific anion.

15 Claims, 4 Drawing Sheets

(51) Int. Cl.

| | |
|---|---|
| ***G03G 15/08*** | (2006.01) |
| ***G03G 21/00*** | (2006.01) |
| *G03G 21/18* | (2006.01) |

(56) References Cited

U.S. PATENT DOCUMENTS

| | | | | |
|---|---|---|---|---|
| 8,600,273 | B2 | 12/2013 | Yamada et al. | |
| 8,655,222 | B2 | 2/2014 | Nakamura et al. | |
| 8,706,011 | B2 | 4/2014 | Anan et al. | |
| 8,768,226 | B2 | 7/2014 | Koyanagi et al. | |
| 8,768,227 | B2 | 7/2014 | Urushihara et al. | |
| 8,774,677 | B2 | 7/2014 | Sakurai et al. | |
| 8,798,508 | B2 | 8/2014 | Yamada et al. | |
| 8,837,985 | B2 | 9/2014 | Ishida et al. | |
| 8,846,287 | B2 | 9/2014 | Yamada et al. | |
| 8,874,007 | B2 | 10/2014 | Kawamura et al. | |
| 8,874,012 | B2 | 10/2014 | Yamada et al. | |
| 8,913,930 | B2 | 12/2014 | Ishii et al. | |
| 9,665,028 | B2 * | 5/2017 | Arimura | G03G 15/0818 |
| 2014/0221184 | A1 * | 8/2014 | Arimura | G03G 15/0818 492/18 |
| 2014/0287899 | A1 | 9/2014 | Nishioka et al. | |
| 2015/0329474 | A1 * | 11/2015 | Shintou | C07C 311/48 252/500 |
| 2015/0331339 | A1 | 11/2015 | Yamada et al. | |
| 2015/0331340 | A1 * | 11/2015 | Nishioka | G03G 15/0233 492/18 |
| 2015/0331341 | A1 | 11/2015 | Yamaguchi et al. | |
| 2015/0331342 | A1 | 11/2015 | Yamaguchi et al. | |
| 2015/0331343 | A1 | 11/2015 | Yamada et al. | |
| 2015/0331346 | A1 | 11/2015 | Yamauchi et al. | |
| 2015/0331347 | A1 | 11/2015 | Arimura et al. | |
| 2015/0355570 | A1 | 12/2015 | Koyanagi et al. | |
| 2015/0355571 | A1 * | 12/2015 | Mizumoto | H01B 1/122 399/286 |
| 2016/0187801 | A1 | 6/2016 | Yamada et al. | |
| 2016/0187809 | A1 | 6/2016 | Yamaguchi et al. | |

FOREIGN PATENT DOCUMENTS

| | | | | |
|---|---|---|---|---|
| JP | 2011-118113 | | 6/2011 | |
| JP | 2013195509 | A * | 9/2013 | |
| JP | 2015004815 | A * | 1/2015 | |
| JP | 2016102989 | A * | 6/2016 | |
| WO | WO-2006012513 | A2 * | 2/2006 | B01J 20/22 |
| WO | WO-2014091753 | A1 * | 6/2014 | G03G 15/0818 |

OTHER PUBLICATIONS

Hideaki Shirota, et al., "Comparison Between Dicationic and Monocationic Ionic Liquids: Liquid Density, Thermal Properties, Surface Tension, and Shear Viscosity," J. Chem. & Eng. Data, 2011, 56, 2453-2459.*

Katherine L. Van Aken, et al., "Effect of Cation on Diffusion Coefficient of Ionic Liquids at Onion-like Carbon Electrodes," J. Phys. Condens. Matter, 2014, 26, 284104.*

Machine translation of JP2013195509, performed on Espacenet Jul. 6, 2018.*

Pagano, F., et al. "Dicationic ionic liquids as lubricants." Proceedings of the Institution of Mechanical Engineers, Part J: Journal of Engineering Tribology 226.11 (2012): 952-964.*

* cited by examiner

ELECTROPHOTOGRAPHIC MEMBER, PROCESS CARTRIDGE, AND ELECTROPHOTOGRAPHIC APPARATUS

BACKGROUND OF THE INVENTION

Field of the Invention

The present invention relates to an electrophotographic member to be used in an electrophotographic apparatus, and a process cartridge and an electrophotographic apparatus each including the electrophotographic member.

Description of the Related Art

In an electrophotographic apparatus (a copying machine, facsimile, or printer employing an electrophotographic system), an image is formed through the following process. First, an electrophotographic photosensitive member (hereinafter sometimes referred to as "photosensitive member") is charged by a charging member and then exposed by a laser, to thereby form an electrostatic latent image on the photosensitive member. Next, toner in a developer container is applied onto a developing roller by a toner feed roller and a developing blade. The electrostatic latent image on the photosensitive member is developed with the toner conveyed to a developing region by the developing roller at a portion in which the photosensitive member and the developing roller are in contact with, or close to, each other. After that, the toner on the photosensitive member is transferred onto recording paper by a transfer unit, and is fixed by heat and pressure to form an image. The toner remaining on the photosensitive member is removed by a cleaning blade.

In the electrophotographic apparatus, an electrophotographic member including an electroconductive layer is used as each of the developing roller, the charging member, the toner feed roller, the cleaning blade, and the developing blade. The electrophotographic member needs to have its electrical resistance value controlled to the range of from $10^5\Omega$ to $10^9\Omega$ without dependence on its use conditions and use environment. As an electroconductive agent to be added to the electroconductive layer to adjust electroconductivity of the electrophotographic member, there is known an ionic electroconductive agent typified by a quaternary ammonium salt compound. The ionic electroconductive agent has the following advantage as compared to the case of using, as the electroconductive agent, an electronic electroconductive agent like carbon black: by virtue of high dispersibility of the electroconductive agent, unevenness in electrical resistance value hardly occurs. Meanwhile, the ionic electroconductive agent has the following property: its electroconductivity is liable to fluctuate depending on an environment, and for example, the electroconductivity decreases under a low-temperature and low-humidity environment. Accordingly, the ionic electroconductive agent has had a problem in that the electrophotographic member cannot achieve a desired resistance value in some cases under the low-temperature and low-humidity environment.

As an approach to solving such problem, in Japanese Patent Application Laid-Open No. 2004-331885, there is a disclosure of a method involving using, as the electroconductive agent, an ionic liquid having a specific structure. In addition, in Japanese Patent Application Laid-Open No. 2011-118113, there is a disclosure of an electroconductive roller including a urethane coat layer obtained by curing a urethane resin composition containing a specific amount of an ionic liquid having two hydroxy groups.

In recent years, the electrophotographic apparatus has been required to be capable of maintaining high image quality and high durability even under a more severe environment.

One aspect of the present invention is directed to providing an electrophotographic member which hardly undergoes deformation even when subjected to a load over a long period of time under a high-temperature and high-humidity environment and thus can stably form a high-quality electrophotographic image.

Another aspect of the present invention is directed to providing an electrophotographic apparatus which can stably output a high-quality electrophotographic image and a process cartridge to be used in the apparatus.

SUMMARY OF THE INVENTION

According to one aspect of the present invention, there is provided an electrophotographic member, including: an electroconductive substrate; and an electroconductive resin layer on the substrate, in which the resin layer contains a cation having any one structure selected from the group consisting of the following structural formulae (1) to (6), and an anion, and in which the anion includes at least one selected from the group consisting of a fluoroalkylsulfonylimide anion and a fluorosulfonylimide anion:

A11-R101-A12 (1)

in the structural formula (1), A11 and A12 each independently represent any one structure selected from the group consisting of the following structural formulae (A101) to (A106), and R101 represents a linking group having a straight chain moiety of 4 or more carbon atoms, the linking group making a distance corresponding to a straight chain of 4 or more carbon atoms between A11 and A12;

(2)

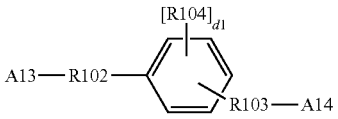

in the structural formula (2), A13 and A14 each independently represent any one structure selected from the group consisting of the following structural formulae (A101) to (A106), R102 and R103 each independently represent a divalent hydrocarbon group having 1 or more and 4 or less carbon atoms, R104 represents a monovalent hydrocarbon group having 1 or more and 4 or less carbon atoms, and d1 represents an integer of 0 or 1;

(3)

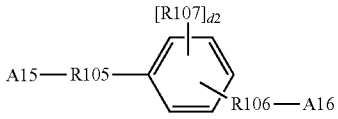

in the structural formula (3), A15 and A16 each independently represent any one structure selected from the group consisting of the following structural formulae (A101) to (A106), R105 and R106 each independently represent a divalent hydrocarbon group having 1 or more and 4 or less carbon atoms, R107 represents a monovalent hydrocarbon group having 1 or more and 4 or less carbon atoms, and d2 represents an integer of 0 or 1;

(4)

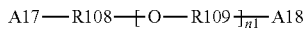

in the structural formula (4), A17 and A18 each independently represent any one structure selected from the group consisting of the following structural formulae (A101) to (A106), n1 represents an integer of 1 or more and 4 or less, and R108 and R109 constitute a part of a linking group for making a distance corresponding to a straight chain formed of at least 4 carbon atoms and 1 oxygen atom between A17 and A18, and each independently represent a divalent hydrocarbon group having 2 or more and 4 or less carbon atoms;

(5)

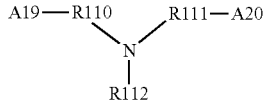

in the structural formula (5), A19 and A20 each independently represent any one structure selected from the group consisting of the following structural formulae (A101) to (A106), R112 represents a hydrogen atom, or a monovalent hydrocarbon group having 1 or more and 4 or less carbon atoms, and R110 and R111 constitute a part of linking group for binding A19 and A20, and each independently represent a divalent hydrocarbon group having 2 or more and 4 or less carbon atoms, for making a distance corresponding to a straight chain of at least 2 carbon atoms between each of A19 and A20, and a nitrogen atom;

(6)

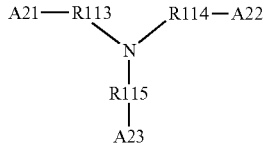

in the structural formula (6), A21 to A23 each independently represent any one structure selected from the group consisting of the following structural formulae (A101) to (A106), and R113 to R115 constitute a part of a linking group for binding A21 to A23, and each independently represent a divalent hydrocarbon group having 2 or more and 4 or less carbon atoms, for making a distance corresponding to a straight chain of at least 2 carbon atoms between each of A21 to A23, and a nitrogen atom;

(A101)

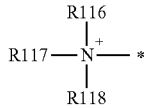

in the structural formula (A101), R116 to R118 each independently represent a monovalent hydrocarbon group having 1 or more and 12 or less carbon atoms, and symbol "*" represents a bonding site with any one of the structural formulae (1) to (6);

(A102)

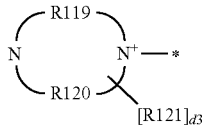

in the structural formula (A102), R119 and R120 each independently represent a hydrocarbon group needed for forming a nitrogen-containing heteroaromatic six-membered ring in the structural formula (A102), R121's each independently represent a monovalent hydrocarbon group having 1 or more and 12 or less carbon atoms, d3 represents an integer of from 0 to 2, and symbol "*" represents a bonding site with any one of the structural formulae (1) to (6);

(A103)

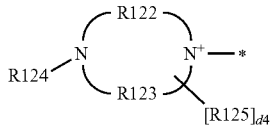

in the structural formula (A103), R122 and R123 each independently represent a hydrocarbon group needed for forming a nitrogen-containing heteroaromatic five-membered ring in the structural formula (A103), R124 represents a hydrogen atom, or a monovalent hydrocarbon group having 1 or more and 12 or less carbon atoms, R125's each independently represent a monovalent hydrocarbon group having 1 or more and 12 or less carbon atoms, d4 represents an integer of from 0 to 2, and symbol "*," represents a bonding site with any one of the structural formulae (1) to (6);

(A104)

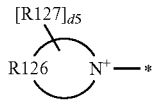

in the structural formula (A104), R126 represents a hydrocarbon group needed for forming a nitrogen-containing heteroaromatic ring in the structural formula (A104), R127's each independently represent a monovalent hydrocarbon group having 1 or more and 12 or less carbon atoms, d5 represents an integer of from 0 to 2, and symbol "*" represents a bonding site with any one of the structural formulae (1) to (6);

(A105)

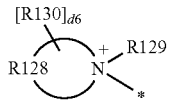

in the structural formula (A105), R128 represents a hydrocarbon group needed for forming a nitrogen-containing heterocyclic nonaromatic ring in the structural formula (A105), R129 represents a hydrogen atom, or a monovalent hydrocarbon group having 1 or more and 12 or less carbon atoms, R130's each independently represent a monovalent hydrocarbon group having 1 or more and 12 or less carbon atoms, d6 represents an integer of from 0 to 2, and symbol "*" represents a bonding site with any one of the structural formulae (1) to (6); and (A106)

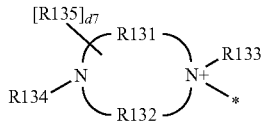

in the structural formula (A106), R131 and R132 each independently represent a hydrocarbon group needed for forming a nitrogen-containing heterocyclic nonaromatic ring in the structural formula (A106), R133 and R134 each independently represent a hydrogen atom, or a monovalent hydrocarbon group having 1 or more and 12 or less carbon atoms, R135's each independently represent a monovalent hydrocarbon group having 1 or more and 12 or less carbon atoms, d7 represents an integer of from 0 to 2, and symbol "*" represents a bonding site with any one of the structural formulae (1) to (6).

According to another aspect of the present invention, there is provided an electrophotographic member, including: an electroconductive substrate; and an electroconductive resin layer on the substrate, in which the resin layer contains a resin having any one structure selected from the group consisting of the following structural formulae (7) to (12) in a molecule, and an anion, and in which the anion includes at least one selected from the group consisting of a fluoroalkylsulfonylimide anion and a fluorosulfonylimide anion:

E11-R201-E12 (7)

in the structural formula (7), E11 and E12 each independently represent any one structure selected from the group consisting of the following structural formulae (E101) to (E106), and R201 represents a linking group having a straight chain moiety of 4 or more carbon atoms, the linking group making a distance corresponding to a straight chain of 4 or more carbon atoms between E11 and E12;

(8)

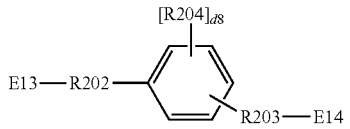

in the structural formula (8), E13 and E14 each independently represent any one structure selected from the group consisting of the following structural formulae (E101) to (E106), R202 and R203 each independently represent a divalent hydrocarbon group having 1 or more and 4 or less carbon atoms, R204 represents a monovalent hydrocarbon group having 1 or more and 4 or less carbon atoms, and d8 represents an integer of 0 or 1;

(9)

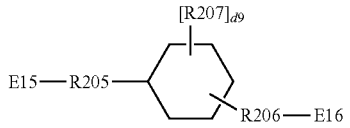

in the structural formula (9), E15 and E16 each independently represent any one structure selected from the group consisting of the following structural formulae (E101) to (E106), R205 and R206 each independently represent a divalent hydrocarbon group having 1 or more and 4 or less carbon atoms, R207 represents a monovalent hydrocarbon group having 1 or more and 4 or less carbon atoms, and d9 represents an integer of 0 or 1;

(10)

in the structural formula (10), E17 and E18 each independently represent any one structure selected from the group consisting of the following structural formulae (E101) to (E106), n2 represents an integer of 1 or more and 4 or less, and R208 and R209 constitute a part of a linking group for making a distance corresponding to a straight chain formed of at least 4 carbon atoms and 1 oxygen atom between E17 and E18, and each independently represent a divalent hydrocarbon group having 2 or more and 4 or less carbon atoms;

(11)

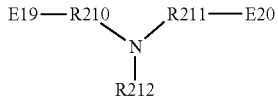

in the structural formula (11), E19 and E20 each independently represent any one structure selected from the group consisting of the following structural formulae (E101) to (E106), R212 represents a hydrogen atom, or a monovalent hydrocarbon group having 1 or more and 4 or less carbon atoms, and R210 and R211 constitute a part of a linking group for binding E19 to E20, and each independently represent a divalent hydrocarbon group having 2 or more and 4 or less carbon atoms, for making a distance corresponding to a straight chain of at least 2 carbon atoms between each of E19 and E20, and a nitrogen atom;

(12)

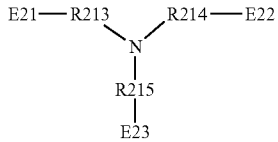

in the structural formula (12), E21 to E23 each independently represent any one structure selected from the group consisting of the following structural formulae (E101) to (E106), and R213 to R215 constitute a part of a linking group for binding E21 to E23, and each independently represent a divalent hydrocarbon group having 2 or more and 4 or less carbon atoms, for making a distance corresponding to a straight chain of at least 2 carbon atoms between each of E21 to E23, and a nitrogen atom;

(E101)

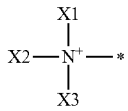

in the structural formula (E101), X1 to X3 each independently represent a monovalent hydrocarbon group having 1 or more and 12 or less carbon atoms, or a bonding site with the resin, at least one of X1 to X3 represents a bonding site with the resin, and symbol "*" represents a bonding site with any one of the structural formulae (7) to (12);

(E102)

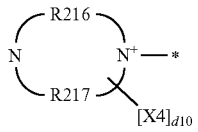

in the structural formula (E102), R216 and R217 each independently represent a hydrocarbon group needed for forming a nitrogen-containing heteroaromatic six-membered ring in the structural formula (E102), X4's each independently represent a monovalent hydrocarbon group having 1 or more and 12 or less carbon atoms, or a bonding site with the resin, d10 represents an integer of 1 or 2, at least one of X4's represents a bonding site with the resin, and symbol "*" represents a bonding site with any one of the structural formulae (7) to (12);

(E103)

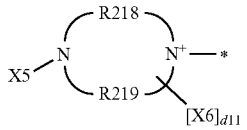

in the structural formula (E103), R218 and R219 each independently represent a hydrocarbon group needed for forming a nitrogen-containing heteroaromatic five-membered ring in the structural formula (E103), X5 represents a hydrogen atom, a monovalent hydrocarbon group having 1 or more and 12 or less carbon atoms, or a bonding site with the resin, X6's each independently represent a monovalent hydrocarbon group having 1 or more and 1.2 or less carbon atoms, or a bonding site with the resin, d11 represents an integer of from 0 to 2, at least one of X5 and X6's represents a bonding site with the resin, and symbol "*" represents a bonding site with any one of the structural formulae (7) to (12);

(E104)

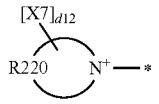

in the structural formula (E104), R220 represents a hydrocarbon group needed for forming a nitrogen-containing heteroaromatic ring in the structural formula (E104), X7's each independently represent a monovalent hydrocarbon group having 1 or more and 12 or less carbon atoms, or a bonding site with the resin, d12 represents an integer of 1 or 2, at least one of X7's represents a bonding site with the resin, and symbol "*" represents a bonding site with any one of the structural formulae (7) to (12);

(E105)

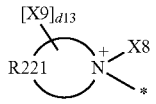

in the structural formula (E105), R221 represents a hydrocarbon group needed for forming a nitrogen-containing heterocyclic nonaromatic ring in the structural formula (E105), X8 represents a hydrogen atom, a monovalent hydrocarbon group having 1 or more and 12 or less carbon atoms, or a bonding site with the resin, X9's each independently represent a monovalent hydrocarbon group having 1 or more and 12 or less carbon atoms, or a bonding site with the resin, d13 represents an integer of from 0 to 2, at least one of X8 and X9's represents a bonding site with the resin, and symbol "*" represents a bonding site with any one of the structural formulae (7) to (12); and (E106)

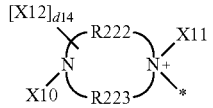

in the structural formula (E106), R222 and R223 each independently represent a hydrocarbon group needed for forming a nitrogen-containing heterocyclic nonaromatic ring in the structural formula (E106), X10 and X11 each independently represent a hydrogen atom, a monovalent hydrocarbon group having 1 or more and 12 or less carbon atoms, or a bonding site with the resin, X12's each independently represent a monovalent hydrocarbon group having 1 or more and 12 or less carbon atoms, or a bonding site with the resin, d14 represents an integer of from 0 to 2, at least one of X10 to X12's represents a bonding site with the resin, and symbol "*" represents a bonding site with any one of the structural formulae (7) to (12).

According to still another aspect of the present invention, there are provided a process cartridge, which is detachably attachable to an electrophotographic apparatus, the process cartridge including the electrophotographic member, and an electrophotographic apparatus, including the electrophotographic member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An investigation made by the inventors of the present invention has revealed that an electroconductive roller containing an ionic liquid disclosed in each of Japanese Patent Application Laid-Open No. 2004-331885 and Japanese Patent Application Laid-Open No. 2011-118113 has excellently reduced unevenness in electrical resistance value, but when subjected to a load by abutting on another member over a long period of time under a high-temperature and high-humidity environment, undergoes a decrease in recoverability of deformation occurring in the abutting portion in some cases. To cope with such problem, the inventors of the present invention have made further investigations. As a result, the inventors have found that an electrophotographic member containing, in its resin layer, a cation having a specific chemical structure or a resin having a specific chemical structure, and a specific anion hardly undergoes deformation even when subjected to a load over a long period of time under a high-temperature and high-humidity environment.

(1) Electrophotographic Member

An electrophotographic member according to one embodiment of the present invention includes an electroconductive substrate and an electroconductive resin layer on the substrate.

Figure 1A:
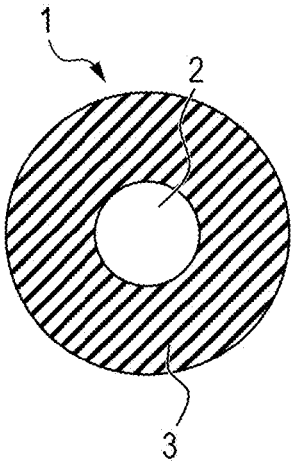
FIG. 1A, FIG. 1B, and FIG. 1C are each a schematic sectional view of an example of an electrophotographic roller according to one aspect of the present invention.
Figure 1B:
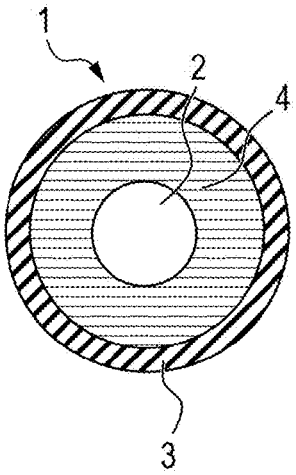
Figure 1C:
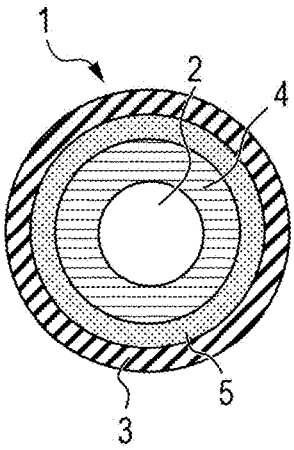

An example of the electrophotographic member is an electrophotographic member having a roller shape (electrophotographic roller). FIG. 1A to FIG. 1C are each a schematic sectional view of the electrophotographic roller in a direction orthogonal to its longitudinal direction. An electrophotographic roller 1 illustrated in FIG. 1A includes an electroconductive substrate 2 and an electroconductive resin layer 3 arranged on the outer periphery of the electroconductive substrate 2. As illustrated in FIG. 1B, an elastic layer 4 may be further arranged between the substrate 2 and the resin layer 3. In addition, the electrophotographic roller 1 may have a three-layer structure in which an intermediate layer 5 is arranged between the elastic layer 4 and the resin layer 3 as illustrated in FIG. 1C, or may have a multi-layer construction in which a plurality of intermediate layers 5 are arranged.

As illustrated in each of FIG. 1A to FIG. 1C, in order for the electrophotographic roller 1 to more effectively exhibit an effect according to the one embodiment of the present invention, it is preferred that the resin layer 3 be present as the outermost layer of the electrophotographic roller 1. In addition, the electrophotographic roller 1 preferably includes the elastic layer 4.

The layer construction of the electrophotographic roller 1 is not limited to the layer construction in which the resin layer 3 is present as the outermost layer of the electrophotographic roller 1. Specific examples of the electrophotographic roller 1 include: one including the substrate 2 and the electroconductive resin layer 3 arranged on the outer periphery of the substrate 2 and further including a surface layer on the resin layer 3; and one including another resin layer 3 as the intermediate layer 5.

Figure 2:
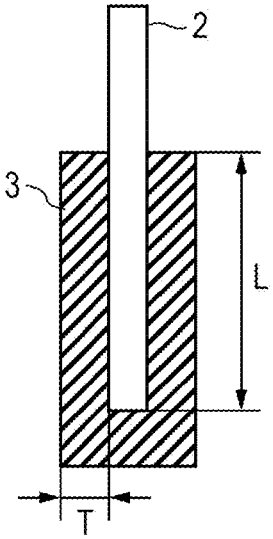
FIG. 2 is a conceptual sectional view of an example of an electrophotographic blade according to one aspect of the present invention.

In addition, another example of the electrophotographic member is an electrophotographic member having a blade shape (electrophotographic blade). FIG. 2 is a schematic sectional view of an example of the electrophotographic blade in a direction orthogonal to its longitudinal direction. The electrophotographic blade includes the electroconductive substrate 2 and the electroconductive resin layer 3 arranged on the outer periphery of the electroconductive substrate 2.

The electrophotographic member may be used for each of a developing roller, a charging member, a toner feed roller, a developing blade, and a cleaning blade. In particular, the electrophotographic member may be suitably used as each of a developing roller, a developing blade, and a toner feed roller.

Now, the construction of the electrophotographic member according, to the one embodiment of the present invention is described in detail.

«Substrate»

The substrate 2 functions as a support member for the electrophotographic member, and in some cases, as an electrode. The substrate 2 is formed of an electroconductive material, such as: a metal or an alloy like aluminum, a copper alloy, or stainless steel; iron subjected to plating treatment with chromium or nickel; or a synthetic resin having electroconductivity. When the electrophotographic member has a roller shape, the substrate 2 has a solid columnar shape or a hollow cylindrical shape. When the electrophotographic member has a blade shape, the substrate 2 has a thin-plate shape.

«Elastic Layer»

The elastic layer 4 is configured to impart, particularly when the electrophotographic member has a roller shape (electrophotographic roller 1), elasticity needed for forming a nip having a predetermined width in an abutting portion between the electrophotographic roller 1 and a photosensitive member, to the electrophotographic roller 1.

It is preferred that the elastic layer 4 be a molded product of a rubber material. Examples of the rubber material include an ethylene-propylene-diene copolymerized rubber, an acrylonitrile-butadiene rubber, a chloroprene rubber, a natural rubber, an isoprene rubber, a styrene-butadiene rubber, a fluororubber, a silicone rubber, an epichlorohydrin rubber, and a urethane rubber. One kind of those materials may be used alone, or two or more kinds thereof may be used as a mixture. Of those, a silicone rubber is particularly preferred from the viewpoints of compression set and flexibility. The silicone rubber is, for example, a cured product of an addition-curable silicone rubber.

As a method of forming the elastic layer 4, there is given a method involving mold molding of a liquid rubber material, or a method involving extrusion molding of a kneaded rubber material.

An electroconductivity-imparting agent is appropriately blended into the elastic layer 4 in order to impart electroconductivity to the elastic layer. Carbon black; an electroconductive metal, such as aluminum or copper; or fine particles of an electroconductive metal oxide, such as tin oxide or titanium oxide, may be used as the electroconductivity-imparting agent. Of those, carbon black is particularly preferred because the carbon black is relatively easily available and provides good electroconductivity. When the carbon black is used as the electroconductivity-imparting agent, the carbon black is preferably blended in an amount of from 2 parts by mass to 50 parts by mass with respect to 100 parts by mass of the rubber.

Various additives, such as a non-electroconductive filler, a crosslinking agent, and a catalyst, may be each appropriately blended into the elastic layer 4. Examples of the non-electroconductive filler include silica, quartz powder, titanium oxide, and calcium carbonate. Examples of the crosslinking agent include di-t-butyl peroxide, 2,5-dimethyl-2,5-di(t-butylperoxy)hexane, and dicumyl peroxide.

The thickness of the elastic layer 4 is preferably 0.3 mm or more and 4.0 mm or less.

«Resin Layer»

<Resin Layer According to First Embodiment>

Now, the construction of a resin layer in an electrophotographic member according to a first embodiment of the present invention is described in detail.

The resin layer according to the first embodiment contains a cation having any one structure selected from the group consisting of the structural formulae (1) to (6) to be described in detail below, and an anion, and the anion is at least one selected from the group consisting of a fluoroalkylsulfonylimide anion and a fluorosulfonylimide anion.

That is, in the resin layer. 3 according to the first embodiment, the cation has two or three cation groups in one molecule and has a specific chemical structure between the cation groups.

The inventors of the present invention presume as follows with regard to the reason why the use of an ionic electroconductive agent formed of such cation and anion suppresses a decrease in deformation recoverability of the electrophotographic member.

The inventors of the present invention presume that the deformation recoverability of an electroconductive roller having an ionic liquid added thereto as an electroconductive agent decreases because of clusterization of the ionic liquid. When the ionic liquid is added as the electroconductive agent to a resin, owing to an interaction acting between molecules in the binder, the cation and the anion of the ionic liquid may be aggregated to form a cluster. That is, the inventors of the present invention presume that the deformation recoverability of the electroconductive roller having the ionic liquid added thereto as the electroconductive agent decreases because the clusterization of the ionic liquid forms a domain of an aggregate of ions in the resin to impair the homogeneity of the resin layer.

Meanwhile, the cation having any one structure selected from the group consisting of the structural formulae (1) to (6) to be described in detail below has a specific chemical structure between cation groups, and hence the cation groups are less liable to approach each other by virtue of the chemical structure functioning as a spacer. The clusterization of ions is considered to be suppressed consequently, as compared to an ionic electroconductive agent having no spacer.

(Cation)

The cation has a feature of having two or three cation groups in one molecule and having a specific chemical structure between the cation groups.

Now, the cation having any one structure selected from the group consisting of the structural formulae (1) to (6) is described in detail.

A11-R101-A12 (1)

In the structural formula (1), A11 and A12 each independently represent any one structure selected from the group consisting of the structural formulae (A101) to (A106) to be described later. R101 represents a linking group for binding the cation group represented by A11 and the cation group represented by A12. The linking group functions as a spacer between both the cation groups. In addition, the linking group makes, between A11 and A12, a distance corresponding to a straight chain of at least 4 carbon atoms (C4), particularly preferably a distance corresponding to a straight chain of 6 or more carbon atoms. An example of R101 is a hydrocarbon group having a straight chain moiety of C4 or more, preferably C6 or more. Such hydrocarbon group may be a divalent saturated or unsaturated hydrocarbon group. The hydrocarbon group of R101 particularly preferably has 6 or more and 12 or less carbon atoms.

Specific examples of the hydrocarbon group of R101 are shown below.

A linear or branched alkylene group having 4 to 18 carbon atoms, such as a n-butylene group, a n-hexylene group, a n-octylene group, a n-decylene group, a n-dodecylene group, a n-hexadecylene group, a n-octadecylene group, a 3-methyl-1,5-pentylene group, or a 2,4-dimethyl-1,6-hexylene group A linear or branched alkenylene group having 4 to 18 carbon atoms, such as a 1-butenylene group, a 2-butenylene group, a 1-pentenylene group, a 2-pentenylene group, a 1-octenylene group, a 2-octenylene group, a 3-octenylene group, a 4-octenylene group, or a 1-octadecenylene group A linear or branched alkynylene group having 4 to 18 carbon atoms, such as a 1-butynylene group or a 2-butynylene group (2)

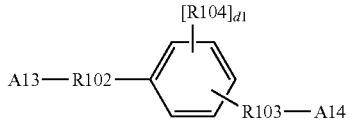

In the structural formula (2), A13 and A14 each independently represent any one structure selected from the group consisting of the structural formulae (A101) to (A106) to be described later. d1 represents an integer of 0 or 1. R104 represents a monovalent hydrocarbon group having 1 or more and 4 or less carbon atoms, which is bonded to a carbon atom of the benzene ring in the structural formula (2) to which R102 and R103 are not bonded. Specific examples of R104 include a methyl group, an ethyl group, a n-propyl group, an isopropyl group, a n-butyl group, an isobutyl group, and a t-butyl group.

R102 and R103 represent groups constituting a part of a linking group containing a phenylene group, for binding the cation groups represented by A13 and A14 and functioning as a spacer between both the cation groups. R103 and R104 each independently represent a divalent hydrocarbon group having 1 or more and 4 or less carbon atoms.

Specific examples of the linking group in the structural formula (2) in the case of d1=0 include an o-xylylene group, a m-xylylene group, a p-zylylene group, a 1,2-phenylene diethylene group, a 1,3-phenylene diethylene group, a 1,4-phenylene diethylene group, a 1,2-phenylene-di-4-butylene group, a 1, 3-phenylene-di-4-butylene group, and a 1,4-phenylene-di-4-butylene group.

(3)

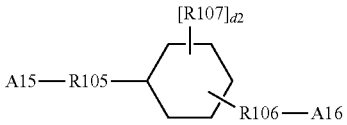

In the structural formula (3), A15 and A16 each independently represent any one structure selected from the group consisting of the structural formulae (A101) to (A106) to be described later. d2 represents an integer of 0 or 1. R107 represents a monovalent hydrocarbon group having 1 or more and 4 or less carbon atoms, which is bonded to a carbon atom of the cyclohexane ring in the structural formula (3) to which R105 and R106 are not bonded. Specific examples of R107 include a methyl group, an ethyl group, a n-propyl group, an isopropyl group, a n-butyl group, an isobutyl group, and a t-butyl group.

R105 and R106 represent groups constituting a part of a linking group containing a cyclohexane group, for binding the cation groups represented by A15 and A16 and functioning as a spacer between both the cation groups. R105 and R106 each independently represent a divalent hydrocarbon group having 1 or more and 4 or less carbon atoms.

Specific examples of the linking group in the structural formula (3) in the case of d2=0 include a 1,2-cyclohexane dimethylene group, a 1,3-cyclohexane dimethylene group, a 1,4-cyclohexane dimethylene group, a 1,2-cyclohexane-di-2-ethylene group, a 1,3-cyclohexane-di-2-ethylene group, and a 1,4-cyclohexane-di-2-ethylene group.

(4)

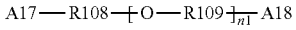

In the structural formula (4), A17 and A18 each independently represent any one structure selected from the group consisting of the structural formulae (A101) to (A106) to be described later. n1 represents an integer of 1 or more and 4 or less.

R108 and R109 represent groups constituting a part of a linking group for binding the cation group represented by A17 and the cation group represented by A18 and functioning as a spacer between both the cation groups. The linking group makes, between A17 and A18, a distance corresponding to a straight chain formed of at least 4 carbon atoms and 1 oxygen atom, and R108 and R109 each independently represent a divalent hydrocarbon group having 2 or more and 4 or less carbon atoms.

Specific examples of the linking group having such hydrocarbon group include the groups which are formed by removing the hydroxy groups at both terminals of each of the following diols: diethylene glycol, triethylene glycol, tetraethylene glycol, dipropylene glycol, tripropylene glycol, tetrapropylene glycol, di-tetramethylene ether glycol, tri-tetramethylene ether glycol, and tetra-tetramethylene ether glycol.

(5)

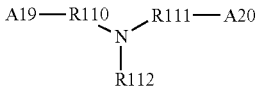

In the structural formula (5), A19 and A20 each independently represent any one structure selected from the group consisting of the structural formulae (A101) to (A106) to be described later. R112 represents a hydrogen atom, or a monovalent hydrocarbon group having 1 or more and 4 or less carbon atoms. R110 and R111 represent groups constituting a part of a linking group for binding the cation groups represented by A19 and A20 and functioning as a spacer between both the cation groups. R110 and R111 each independently represent a divalent hydrocarbon group having 2 or more and 4 or less carbon atoms, for making a distance corresponding to a straight chain of at least 2 carbon atoms between each of A19 and A20, and a nitrogen atom.

The linking group in the structural formula (5) may be said to be, for example, a group obtained by removing one hydrogen atom from each of two alkyl groups in an alkylated tertiary amine or an alkylated secondary amine. An example of such group is an N-alkyl-di-alkylene group, such as an N-alkyl-di-2-ethylene group, an N-alkyl-di-3-n-propylene group, and an N-alkyl-di-4-n-butylene group. Herein, the "alkyl" corresponds to R112. In addition, another specific example thereof is an imino-di-alkylene group, such as an imino-di-2-ethylene group, an imino-di-3-n-propylene group, or an imino-di-4-n-butylene group.

(6)

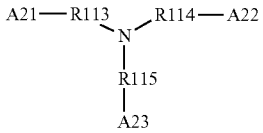

In the structural formula (6), A21 to A23 each independently represent any one structure selected from the group consisting of the structural formulae (A101) to (A106) to be described later. R113 and R115 represent groups constituting a part of a linking group for binding the cation groups represented by A21 to A23 and functioning as a spacer between the respective cation groups. R113 to R115 each independently represent a divalent hydrocarbon group having 2 or more and 4 or less carbon atoms, for making a distance corresponding to a straight chain of at least 2 carbon atoms between each of A21 to A23, and a nitrogen atom.

The linking group in the structural formula (6) may be said to be, for example, a group obtained by removing one hydrogen atom from each of three alkyl groups in an alkylated tertiary amine. Structural examples of such group include a structure obtained by removing a hydrogen atom from each ethyl group of tris-(2-ethyl)amine, a structure obtained by removing a hydrogen atom from each propyl group of tris-(3-n-propyl)amine, and a structure obtained by removing a hydrogen atom from each butyl group of tris-(4-n-butyl)amine.

Now, the structural formulae (A101) to (A106) are described in detail.

(A101)

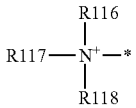

In the structural formula (A101), R116 to R118 each independently represent a monovalent hydrocarbon group having 1 or more and 12 or less carbon atoms, and symbol "*" represents a bonding site with any one of the structural formulae (1) to (6).

The structural formula (A01) specifically represents an ammonium group. R116 to R118 in the ammonium group each particularly preferably represent a monovalent hydrocarbon group having 1 or more and 8 or less carbon atoms. Specific examples of such group include a trimethylammonium group, a triethylammonium group, a tributylammonium group, a dimethylethylammonium group, an octyldimethylammonium group, and a trioctylammonium group.

(A102)

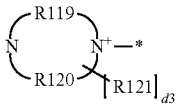

In the structural formula (A102), R119 and R120 each independently represent a hydrocarbon group needed for forming a nitrogen-containing heteroaromatic six-membered ring in the structural formula (A102). d3 represents an integer of from 0 to 2, and symbol "*" represents a bonding site with any one of the structural formulae (1) to (6). R121's each represent a substituent bonded to any one of the carbon atoms in the nitrogen-containing heteroaromatic six-membered ring, and each independently represent a monovalent hydrocarbon group having 1 or more and 12 or less carbon atoms. The hydrocarbon group particularly preferably has 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, and a n-octyl group.

The structural formula (A102) specifically represents an aromatic cation structure containing two nitrogen atoms in a six-membered ring structure. Specific examples of such six-membered ring structure include a pyrazine ring and a pyrimidine ring.

(A103)

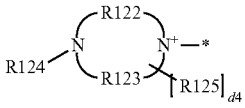

In the structural formula (A103), R122 and R123 each independently represent a hydrocarbon group needed for forming a nitrogen-containing heteroaromatic five-membered ring in the structural, formula (A103). d4 represents an integer of from 0 to 2, and symbol "*" represents a bonding site with any one of the structural formulae (1) to (6).

R124 represents a hydrogen atom, or a monovalent hydrocarbon group having 1 or more and 12 or less carbon atoms, preferably 1 or more and 8 or less carbon atoms. Specific examples thereof include a hydrogen atom, a methyl group, an ethyl group, a n-propyl group, an isopropyl group, a n-butyl group, an isobutyl group, a t-butyl group, a n-hexyl group, and a n-octyl group.

R125's each represent a substituent bonded to any one of the carbon atoms in the nitrogen-containing heteroaromatic five-membered ring, and each independently represent a monovalent hydrocarbon group having 1 or more and 12 or less carbon atoms. The hydrocarbon group particularly preferably has 1 or more and 8 or less carbon atoms. Specific examples of such hydrocarbon group include a methyl group, an ethyl group, a n-propyl group, an isopropyl group, a n-butyl group, an isobutyl group, a t-buty group, a n-hexyl group, and a n-octyl group.

The structural formula (A103) specifically represents an aromatic cation structure containing two nitrogen atoms in a five-membered ring structure. A specific example of such five-membered ring structure is an imidazole ring.

(A104)

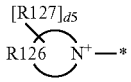

In the structural formula (A104), R126 represents a hydrocarbon group needed for forming a nitrogen-containing heteroaromatic ring in the structural formula (A104). d5 represents an integer of from 0 to 2, and symbol "*" represents a bonding site with any one of the structural formulae (1) to (6).

R127's each represent a substituent bonded to any one of the carbon atoms in the nitrogen-containing heteroaromatic ring, and each independently represent a monovalent hydrocarbon group having 1 or more and 12 or less carbon atoms. The hydrocarbon group particularly preferably has 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, and a n-octyl group.

The structural formula (A104) specifically represents an aromatic cation structure containing one nitrogen atom in a ring structure. The ring structure is preferably a four- to seven-membered ring, particularly preferably a five-membered ring or a six-membered ring. Specific examples of the ring structure in the structural formula (A104) include a pyrrole ring, a pyridine ring, and an azepine ring.

(A105)

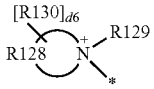

In the structural formula (A105), R128 represents a hydrocarbon group needed for forming a nitrogen-containing heterocyclic nonaromatic ring in the structural formula (A105). d6 represents an integer of from 0 to 2, and symbol "*" represents a bonding site with any one of the structural formulae (1) to (6).

R129 represents a hydrogen atom, or a monovalent hydrocarbon group having 1 or more and 12 or less carbon atoms. Specific examples of R129 include a hydrogen atom, a methyl group, an ethyl group, a n-propyl group, an isopropyl group, a n-butyl group, an isobutyl group, a t-butyl group, a n-hexyl group, a n-octyl group, a n-decyl group, and a n-dodecyl group.

R130's each represent a substituent bonded to any one of the carbon atoms in the nitrogen-containing heterocyclic nonaromatic ring, and each independently represent a monovalent hydrocarbon group having 1 or more and 12 or less carbon atoms. The hydrocarbon group particularly preferably has 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, and a n-octyl group.

The structural formula (A105) specifically represents a nonaromatic cation structure containing one nitrogen atom in a ring structure. The ring structure is preferably a four- to seven-membered ring, particularly preferably a five-membered ring or a six-membered ring. Specific examples of the ring structure in the structural formula (A105) include a pyrrolidine ring, a pyrroline ring, a piperidine ring, an azepane ring, and an azocane ring.

(A106)

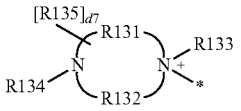

In the structural formula (A106), R131 and R132 each independently represent a hydrocarbon group needed for forming a nitrogen-containing heterocyclic nonaromatic ring in the structural formula (A106). d7 represents an integer of from 0 to 2, and symbol "*" represents a bonding site with any one of the structural formulae (1) to (6).

R133 and R134 each independently represent a hydrogen atom, or a monovalent hydrocarbon group having 1 or more and 12 or less carbon atoms. Specific examples of R133 and R134 include a hydrogen atom, a methyl group, an ethyl group, a n-propyl group, an isopropyl group, a n-butyl group, an isobutyl group, a t-butyl group, a n-hexyl group, and a n-octyl group.

R135's each represent a substituent bonded to any one of the carbon atoms in the nitrogen-containing heterocyclic nonaromatic ring, and each independently represent a monovalent hydrocarbon group having 1 or more and 12 or less carbon atoms. The hydrocarbon group particularly preferably has 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, and a n-octyl group.

The structural formula (A106) specifically represents a nonaromatic cation structure containing two nitrogen atoms in a ring structure. The ring structure is preferably a four- to seven-membered ring, particularly preferably a five-membered ring or a six-membered ring. Specific examples of such ring structure include an imidazolidine ring, an imidazoline ring, a piperazine ring, a diazepane ring, and a diazocane ring.

In the structural formula (A106), specific examples of R135 include a methyl group, an ethyl group, a n-propyl group, an isopropyl group, a n-butyl group, an isobutyl group, a t-butyl group, a n-hexyl group, and a n-octyl group.

The cation is preferably a cation having the structure represented by the structural formula (1) out of the structural formulae (1) to (6) because of its ease of availability. In addition, when the chemical structure between the cation groups is rigid, the cation groups are less liable to approach each other, and hence the cation is preferably a cation having the structure represented by the structural formula (2).

(Anion)

The anion is at least one selected from the group consisting of a fluoroalkylsulfonylimide anion and a fluorosulfonylimide anion. Any such anion is preferred because the anion is excellent in electroconductivity and exhibits stable electroconductivity in a wide temperature region.

Specific examples of the fluoroalkylsulfonylimide anion include a fluoroalkylsulfonylimide anion having a fluoroalkyl group having 1 or more and 6 or less carbon atoms, such as a trifluoromethanesulfonylimide anion, a pentafluoroethylsulfonylimide anion, a heptafluoropropylsulfonylimide anion, a nonafluorobutylsulfonylimide anion, a dodecafluoropentylsulfonylimide anion, and a perfluorohezylsulfonylimide anion, and a cyclic perfluoroalkyldisulfonylimide anion having a four- to seven-membered ring, such as an N, N-hexafluoropropane-1, 3-disulfonylimide anion.

The anion is particularly preferably a fluorosulfonylimide anion, a fluoroalkylsulfonylimide anion having a fluoroalkyl group having 1 or more and 4 or less carbon atoms, or an N,N-hexafluoropropane-1,3-disulfonylimide anion.

(Resin)

The resin layer 3 contains a resin as a binder component, and the resin functions as a bearing member for the above-mentioned cation and the above-mentioned anion.

A known resin may be used as the resin, and is not particularly limited. Specific examples of the resin include a polyurethane resin, a polyester resin, a polyether resin, an acrylic resin, an epoxy resin, an amino resin, such as a melamine resin, an amide resin, an imide resin, an amide imide resin, a phenol resin, a vinyl resin, a silicone resin, a fluororesin, and a polyalkylene imine resin. One kind of those resins may be used alone, or two or more kinds thereof may be used in combination.

Of those, as the resin, a polyurethane resin and a melamine resin are preferred from the viewpoints of the strength of the resin layer and toner chargeability. Further, a thermosetting polyether polyurethane resin and a thermosetting polyester polyurethane resin are suitably used because of having flexibility in addition to the strength and the chargeability.

The thermosetting polyether polyurethane resin and the thermosetting polyester polyurethane resin can be obtained by thermosetting a known polyether polyol, a known polyester polyol, or a known polycarbonate polyol, and an isocyanate compound.

Examples of the polyether polyol include polyethylene glycol, polypropylene glycol, and polytetramethylene glycol. In addition, examples of the polyester polyol include polyester polyols each obtained through a condensation reaction of a diol component, such as 1,4-butanediol, 3-methyl-1, 4-pentanediol, or neopentyl glycol, or a triol component, such as trimethylolpropane, and a dicarboxylic acid, such as adipic acid, phthalic anhydride, terephthalic acid, or hexahydroxyphthalic acid. In addition, examples of the polycarbonate polyol include polycarbonate polyols each obtained through a condensation reaction of a diol component, such as 1,3-propanediol, 1,4-butanediol, 1,6-hexanediol, 3-methyl-1,5-pentanediol, diethylene glycol, polyethylene glycol, polypropylene glycol, or polytetramethylene glycol, and a dialkyl carbonate, such as dimethyl carbonate, or a cyclic carbonate, such as ethylene carbonate.

The polyol component may be formed in advance into a prepolymer through chain extension with an isocyanate, such as 2,4-tolylene diisocyanate (TDI), 1,4-diphenylmethane diisocyanate (MDI), or isophorone diisocyanate (IPDI) as required.

The isocyanate compound is not particularly-limited, and the following compounds may be used: an aliphatic polyisocyanate, such as ethylene diisocyanate and 1,6-hexamethylene di isocyanate (HDI); an alicyclic polyisocyanate, such as isophorone diisocyanate (IPDI), cyclohexane 1,3-diisocyanate, and cyclohexane 1,4-diisocyanate; an aromatic isocyanate, such as 2,4-tolylene diisocyanate, 2,6-tolyl ene diisocyanate (TDI), 4,4'-diphenylmethane diisocyanate (MDI), polymeric diphenylmethane diisocyanate, xylylene diisocyanate, and naphthalene diisocyanate; and a copolymerized product, isocyanurate form, TMP adduct, and biuret form thereof and block forms thereof. Of those, art aromatic isocyanate, such as tolylene diisocyanate, diphenylmethane diisocyanate, or polymeric diphenylmethane diisocyanate, is more suitably used.

The polyol component and the isocyanate compound are preferably mixed so that the ratio of an isocyanate group may fall within the range of from 1.0 equivalent or more to 2.0 equivalents or less with respect to 1.0 equivalent of a hydroxy group. When the mixing ratio falls within the range, the remaining of an unreacted component can be suppressed.

In addition to a thermal curing reaction involving using the isocyanate compound, a compound having a vinyl group or acryloyl group introduced to a terminal thereof can be subjected to a curing reaction with UV light or an electron beam instead of the polyol.

(Method of Forming Resin Layer)

The ionic electroconductive agent containing the cation and the anion is obtained by, for example, allowing the following components to react with each other:

(i) a compound having fluoroalkylsulfonylimide groups or fluorosulfonylimide groups bonded to both terminals of a chemical structure serving as a spacer between the cation groups; and (ii) a tertiary amine or a nitrogen-containing heterocyclic compound.

A specific example of the compound (i) is a compound having any one structure selected from the group consisting of the following structural formulae (1') to (6').

(1')

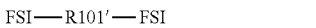

(2')

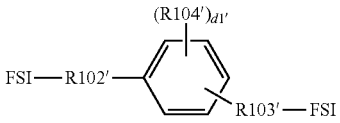

(3')

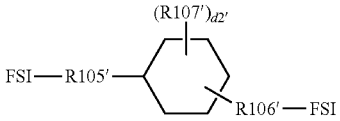

(4')

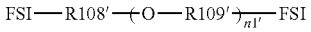

(5')

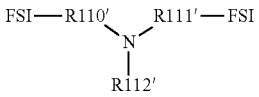

(6')

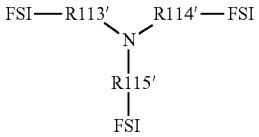

In the structural formulae (1') to (6'), FSI represents a fluoroalkylsulfonylimide group or a fluorosulfonylimide group, and R101' to R115', d1' and d2', and n1' have the same meaning as the corresponding symbols R101 to R115, d1 and d2, and n1, respectively, in the structural formulae (1) to (6). The fluoroalkylsulfonylimide group and the fluorosulfonylimide group are the same as the above-mentioned fluoroalkylsulfonylimide anion and fluorosulfonylimide anion, respectively.

A specific example of the compound (ii) is a compound having any structure selected from the group consisting of the following structural formulae (A101') to (A106').

(A101')

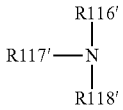

(A102')

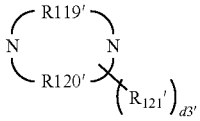

(A103')

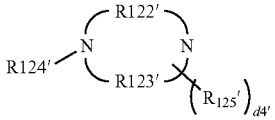

(A104')

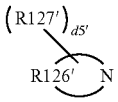

(A105')

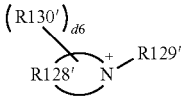

(A106')

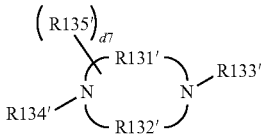

In the structural formulae (A101') to (A106'), R116' to R133' and d3' to d7' have the same meanings as the corresponding symbols R116 to R133 and d3 to d7, respectively, in the structural formulae (A101) to (A106).

Specific examples of the compound represented by the structural formula (A101') include trimethylamine, triethylamine, tributylamine, octyldimethylamine, and trioctylamine.

Specific examples of the compound represented by the structural formula (A102') include 2-methylpyrazine, 2-ethylpyrazine, 2-butylpyrazine, 2-octylpyrazine, 2,5-dimethylpyrazine, 2-ethyl-3-methylpyrazine, 5-ethyl-2, 3-dimethylpyrazine, pyrimidine, 2-methylpyrimidine, 4-methylpyrimidine, 2-ethylpyrimidine, 4-ethylpyrimidine, 4-butylpyrimidine, and 4, 6-dimethylpyrimidine.

Specific examples of the compound represented by the structural formula (A103') include imidazole, 1-methylimidazole, 2-methylimidazole, 4-methylimidazole, 1-ethylimidazole, 2-ethylimidazole, 4-ethylimidazole, 1-butylimidazole, 2-butylimidazole, 1-t-butylimidazole, 1-octylimidazole, 1, 2-dimethylimidazole, and 2-ethyl-4-methylimidazole.

Specific examples of the compound represented by the structural formula (A104') include pyridine, 2-methylpyridine, 3-methylpyridine, 4-methylpyridine, 2-ethylpyridine, 3-ethylpyridine, 4-ethylpyridine, 4-t-butylpyridine, 4-octylpyridine, 2-methyl-4-ethylpyridine, 2-methyl-5-ethylpyridine, 2, 6-dimethylpyridine, 3, 5-dimethylpyridine, and 2,6-di-t-butylpyridine.

Specific examples of the compound represented by the structural formula (A105') include pyrrolidine, 1-methylpyrrolidine, 2-methylpyrrolidine, 1-butylpyrrolidine, 1-t-butylpyrrolidine, 1-octylpyrrolidine, 2, 5-dimethylpyrrolidine, 1-methyl-2-ethylpyrrolidine, piperidine, 1-methylpiperidine, 4-methylpiperidine, 1-ethylpiperidine, 2-ethylpiperidine, 1-butylpiperidine, 2-butylpiperidine, 1-octylpiperidine, 2,6-dimethylpiperidine, 1-methylazepane, 1-ethylazepane, 1-butylazepane, 1-t-butylazepane, 1-octylazepane, and 1-dodecylazepane.

Specific examples of the compound represented by the structural formula (A106') include piperazine, 1-methylpiperazine, 1-ethylpiperazine, 1-butylpiperazine, 1-t-butylpiperazine, 1-octylpiperazine, N,N'-dimethylpiperazine, and N,N'-diethylpiperazine.

An example of the compound represented by the formula (1') is N,N,N',N'-tetra(trifluoromethanesulfonyl)-1, 6-diamine, which is represented by the following structural formula (20), and an example of the compound represented by the formula (A101') is N,N-dimethyl-n-octylamine.

(20)

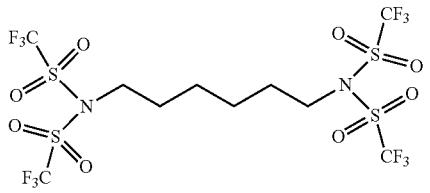

When those compounds are allowed to react with each other, a compound represented by the following structural formula may be obtained. That is, an N,N,N',N'-tetra(trifluoromethanesulfonyl)imide group, which is present at both terminals of a molecule of N,N,N',N'-tetra(trifluoromethanesulfonyl)-1, 6-diamine, turns into an N,N,N',N'-tetra(trifluoromethanesulfonyl)imide anion after the reaction. The compound represented by the following structural formula corresponds to a cation having a structure represented by the structural formula (1).

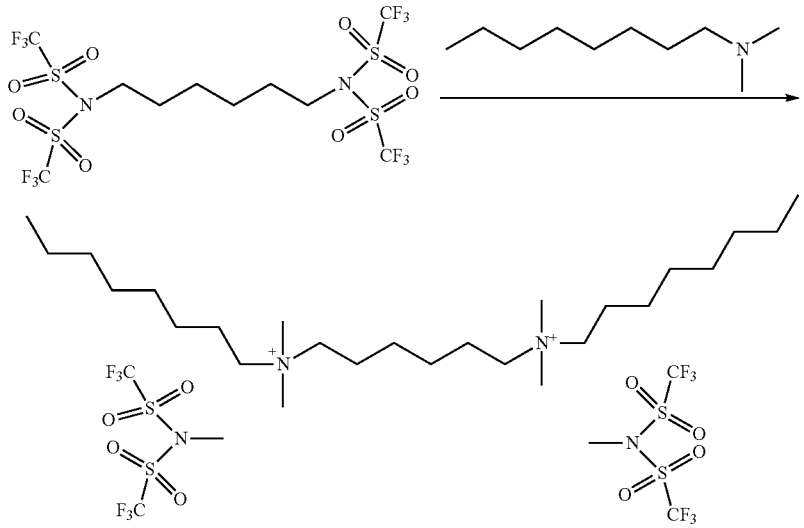

The reaction between the compound (i) and the compound (ii) may be allowed to proceed by heating. The heating temperature is not particularly limited. In consideration of reactivity, the temperature is preferably 30° C. or more and 180° C. or less, particularly preferably 80° C. or more and 140° C. or less. When the heating temperature falls within the range, the generation of the ionic electroconductive agent satisfactorily proceeds.

When a thermosetting polyether-polyurethane resin or a thermosetting polyester-polyurethane resin is used as the resin of the resin layer 3, the generation of the ionic electroconductive agent and the curing of the resin can be simultaneously performed through appropriate adjustment of the heating temperature. That is, through the heating of a mixture obtained by mixing a raw material for the resin, the compound (i), and the compound (ii), the resin layer 3 can be formed by performing heating once.

The content of the ionic electroconductive agent containing the cation and the anion is preferably 0.1 part by mass or more and 10 parts by mass or less with respect to 100 parts by mass of the resin. When the content of the ionic electroconductive agent is 0.1 part by mass or more, an electrophotographic member capable of maintaining high electroconductivity even under a low-temperature environment and achieving a high effect on deformation recoverability can be obtained.

The compound (i) may be produced by a known method. For example, the compound may be obtained by subjecting the following compounds to a reaction with each other:

- a compound having a halogeno group, such as a bromo group and a chloro group, or a hydroxy group bonded to both terminals of a chemical structure serving as a spacer between the cation groups; and
- an alkali metal fluoroalkylsulfonylimide or an alkali metal fluorosulfonyl imide, such as a lithium N,N-bis(fluoroalkyl)sulfonylimide and a potassium N,N-bis(fluoroalkylsulfonyl)imide, or a fluoroalkylsulfonyl imide or a fluorosulfonylimide, such as an N,N-bis(fluoroalkyl) sulfonylimide.

A method of forming the resin layer 3 is not particularly limited, and examples thereof include spray coating, dip coating, and roll coating methods. Of those, a dip coating method involving causing a coating material to overflow from the upper end of a dipping tank as disclosed in Japanese Patent Application Laid-Open No. 57-5047 is preferably used as the method of forming the resin layer 3 because of its simplicity and excellent production stability. The thickness of the resin layer 3 is preferably 5.0 μm or more and 20.0 μm or less.

(Other Component in Resin Layer)

The resin layer 3 may contain a non-electroconductive filler, such as silica, quartz powder, titanium oxide, zinc oxide, and calcium carbonate, as required. Such non-electroconductive filler exhibits, by being added to a coating material for forming the resin layer 3, a function as a film-forming aid when coating with the coating material is performed in the formation process of the resin layer 3. The content of such non-electroconductive filler is preferably 10 parts by mass or more and 30 parts by mass or less with respect to 100 parts by mass of the resin for forming the resin layer 3, namely, the binder resin.

In addition, the resin layer 3 may contain an electroconductive filler in the range that the effect of the present invention is not inhibited, as required. Carbon black, an electroconductive metal, such as aluminum and copper, or fine particles of electroconductive metal oxide, such as zinc oxide, tin oxide, and titanium oxide, may be used as the electroconductive filler. Of those, carbon black is particularly preferably used because the carbon black is relatively easily available and has a high electroconductivity-imparting property and reinforcing property.

In the case where the resin layer 3 is the outermost layer, when some degree of surface roughness is required of the electrophotographic member, fine particles for roughness control may be added to the resin layer 3. Fine particles of a polyurethane resin, a polyester resin, a polyether resin, a polyamide resin, an acrylic resin, or a phenol resin may be used as the fine particles for roughness control. The volume-average particle diameter of the fine particles for roughness control is preferably 3 μm or more and 20 μm or less. The content of the particles for roughness control in the resin layer 3 is preferably 1 part by mass or more and 50 parts by mass or less with respect to 100 parts by mass of the resin for forming the resin layer 3, namely, the binder resin.

<Resin Layer According to Second Embodiment>

A resin layer according to a second embodiment contains a resin having any one structure selected from the group consisting of the structural formulae (7) to (12) to be described in detail below in a molecule, and an anion, and the anion is at least one selected from the group consisting of a fluoroalkylsulfonylimide anion and a fluorosulfonylimide anion.

In the resin layer 3 according to the second embodiment, cation groups are present in the resin, and a specific chemical structure is present between the cation groups. A difference from the resin layer 3 according to the first embodiment is that the cation according to the first embodiment is present as the cation groups in the resin. Other points including a specific chemical structure between the cation groups, a specific aspect of the anion, and the kind of the resin serving as a binder are similar to those of the resin layer 3 according to the first embodiment.

In such resin layer, as with the resin layer according to the first embodiment, it is considered that the specific chemical structure functions as a spacer to suppress the clusterization of ions. As a result, the electrophotographic member including such resin layer has satisfactory deformation recoverability.

The resin layer according to the second embodiment is particularly preferred from the viewpoint of deformation recoverability as compared to the resin layer according to the first embodiment. This is probably because the cation groups are chemically fixed to the binder resin in the resin layer according to the second embodiment, and hence the aggregation of the cation is more suppressed than in the resin layer according to the first embodiment.

Differences from the resin layer 3 according to the first embodiment are described below. Matters other than those described below are similar to those of the resin layer 3 according to the first embodiment.

(Cation Groups in Resin)

The resin according to this embodiment has any one structure selected from the group consisting of the following structural formulae (7) to (12) in the molecule.

E11-R201-E12 (7)

In the structural formula (7), E11 and E12 each independently represent any one structure selected from the group consisting of the following structural formulae (E101) to (E106). R201 represents a linking group for binding the cation group of E11 and the cation group of E12. The linking group functions as a spacer between both the cation structures. In addition, the linking group makes, between the cation structures of E11 and E12, a distance corresponding to a straight chain of at least 4 carbon atoms (C4), particularly preferably a distance corresponding to a straight chain of C6 or more. An example of R201 is a hydrocarbon group having a straight chain moiety of C4 or more, preferably C6 or more. Such hydrocarbon group may be a divalent saturated or unsaturated hydrocarbon group. The hydrocarbon group of R201 particularly preferably has 6 or more and 12 or less carbon atoms. Specific examples of the hydrocarbon group of R201 may include the same ones as the hydrocarbon groups given as specific examples of R101.

(8)

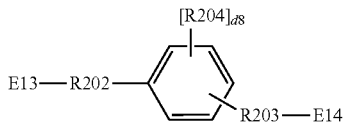

In the structural formula (8), E13 and E14 each independently represent any one structure selected from the group consisting of the following structural formulae (E101) to (E106). d8 represents an integer of 0 or 1.

R204 represents a hydrocarbon group having 1 or more and 4 or less carbon atoms, which is bonded to a carbon atom of the benzene ring in the structural formula (8) to which R202 and R203 are not bonded. Specific examples of R204 include a methyl group, an ethyl group, a n-propyl group, an isopropyl group, a n-butyl group, an isobutyl group, and a t-butyl group.

R202 and R203 represent groups constituting a part of a linking group containing a phenylene group, for binding the respective cation structures of E13 and E34 and functioning as a spacer between both the cation structures. R202 and R203 each independently represent a divalent hydrocarbon group having 1 or more and 4 or less carbon atoms.

Specific examples of the linking group in the structural formula (8) in the case of d8=0 include the same ones as those given as specific examples of the linking group in the structural formula (2) in the case of d1=0.

(9)

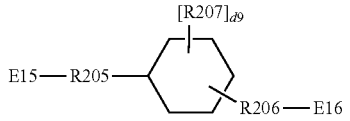

In the structural formula (9), E15 and E16 each independently represent any one structure selected from the group consisting of the following structural formulae (E101) to (E106). d9 represents an integer of 0 or 1. R207 represents a monovalent hydrocarbon group having 1 or more and 4 or less carbon atoms, which is bonded to a carbon atom of the cyclohexane ring in the structural formula (9) to which R205 and R206 are not bonded. Specific examples of R207 include a methyl group, an ethyl group, a n-propyl group, an isopropyl group, a n-butyl group, an isobutyl group, and a t-butyl group.

R205 and R206 represent groups constituting a part of a linking group containing a cyclohexylene group, for binding the cation structures of E15 and E26 and functioning as a spacer between both the cation structures. R205 and R206 each independently represent a divalent hydrocarbon group having 1 or more and 4 or less carbon atoms. Specific examples of the linking group in the structural formula (9) in the case of d9=0 include the same ones as those given as specific examples of the linking group in the structural formula (3) in the case of d2=0.

(10)

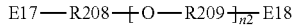

In the structural formula (10), E17 and E18 each independently represent any one structure selected from the group consisting of the following structural formulae (E101) to (E106). n2 represents an integer of 1 or more and 4 or less.

R208 and R209 represent groups constituting a part of a linking group for binding the cation structures of E17 and E18 and functioning as a spacer between both the cation structures. The linking group makes, between the cation structures of E17 and E18, a distance corresponding to a straight chain formed of at least 4 carbon atoms and 1 oxygen atom, and R208 and R209 each independently represent a divalent hydrocarbon group having 2 or more and 4 or less carbon atoms.

Specific examples of the linking group containing such hydrocarbon groups may include the same ones as the specific examples of the linking group of the structural formula (4).

(11)

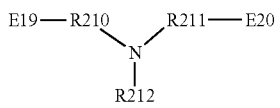

In the structural formula (11), E19 and E20 each independently represent any one structure selected from the group consisting of the following structural formulae (E101) to (E106) to be described later. R212 represents a hydrogen atom, or a monovalent hydrocarbon group having 1 or more and 4 or less carbon atoms.

R210 and R211 represent groups constituting a part of a linking group for binding the cation structures of E19 and E20 and functioning as a spacer between both the cation structures. R210 and R211 each independently represent a divalent hydrocarbon group having 2 or more and 4 or less carbon atoms, for making a distance corresponding to a straight chain of at least 2 carbon atoms between the nitrogen atom and E19, and between the nitrogen atom and E20, in the structural formula (11). Examples of the linking group in the structural formula (11) may include the same ones as those given as examples of the linking group in the structural formula (5).

(12)

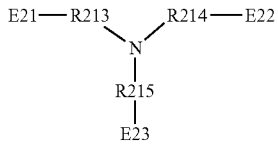

In the structural formula (12), E21 to E23 each independently represent any one cation structure selected from the group consisting of the following structural formulae (E101) to (E106) to be described later. R213 to R215 represent groups constituting a part of a linking group for binding the cation structures of E21 to E23 and functioning as a spacer between the respective cation structures. R213 to R215 each independently represent a divalent hydrocarbon group having 2 or more and 4 or less carbon atoms, for making a distance corresponding to a straight chain of at least 2 carbon atoms between each of E21 to E23, and the nitrogen atom. Examples of the linking group in the structural formula (12) may include the same ones as those given as examples of the linking group in the structural formula (6).

Next, the cation structures represented by the structural formulae (E101) to (E106) are described in detail.

(E101)

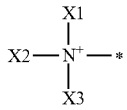

In the structural formula (E101), X1 to X3 each independently represent a monovalent hydrocarbon group having 1 or more and 12 or less carbon atoms, or a bonding site with the resin, at least one of X1 to X3 represents a bonding site with the resin, and symbol. "*" represents a bonding site with any one of the structural formulae (7) to (12).

The structural formula (E101) specifically represents a quaternary ammonium cation having a bonding site with the resin. Details of the part of X1 to X3 forming a bonding site with the resin are described later. Of X1 to X3, X1 to X3 not representing a bonding site with the resin each independently represent a monovalent hydrocarbon group having 1 or more and 12 or less, preferably 1 or more and 8 or less carbon atoms. Examples of such hydrocarbon group include a methyl group, an ethyl group, a butyl group, and an octyl group.

(E102)

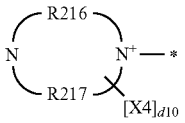

In the structural formula (E102), R216 and R217 each independently represent a hydrocarbon group needed for forming a nitrogen-containing heteroaromatic six-membered ring in the structural formula (E102). d10 represents an integer of 1 or 2. X4 represents a substituent bonded to any one of the carbon atoms in the nitrogen-containing heteroaromatic six-membered ring or a bonding site with the resin, and at least one of X4's constitutes a bonding site with the resin. In addition, symbol "*" represents a bonding site with any one of the structural formulae (7) to (12).

The structural formula (E102) specifically represents an aromatic cation structure having a bonding site with the resin and containing two nitrogen atoms in a six-membered ring structure. Specific examples of such six-membered ring structure include a pyrazine ring and a pyrimidine ring.

X4 constituting a bonding site with the resin is described later. Meanwhile, X4 not constituting a bonding site with the resin represents a hydrocarbon group having 1 or more and 12 or less carbon atoms, preferably 1 or more and 8 or less carbon atoms. Specific examples of the hydrocarbon group include a methyl group, an ethyl group, a n-propyl group, an isopropyl group, a n-butyl group, an isobutyl group, a t-butyl group, a n-hexyl group, and a n-octyl group.

(E103)

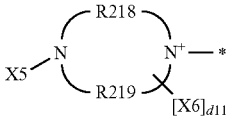

In the structural formula (E103), R218 and R219 each independently represent a hydrocarbon group needed for forming a nitrogen-containing heteroaromatic five-membered ring in the structural formula (E103). d1 represents an integer of from 0 to 2.

X5 represents a hydrogen atom, a monovalent hydrocarbon group having 1 or more and 12 or less carbon atoms, or a bonding site with the resin. X6's each independently represent a monovalent hydrocarbon group having 1 or more and 12 or less carbon atoms, or a bonding site with the resin. At least one of X5 and X6's represents a bonding site with the resin. Symbol "*" represents a bonding site with any one of the structural formulae (7) to (12).

The structural formula (E103) specifically represents an aromatic cation structure having a bonding site with the resin and containing two nitrogen atoms in a five-membered ring structure. A specific example of such five-membered ring structure is an imidazole ring.

X5 or X6 constituting a bonding site with the resin is described later.

Meanwhile, X5 not constituting a bonding site with the resin represents a hydrogen atom, or a monovalent hydrocarbon group having 1 or more and 12 or less carbon atoms. The hydrocarbon group particularly preferably has 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, and a n-octyl group.

In addition, when a plurality of X6's not constituting a bonding site with the resin are present, the plurality of X6's each independently represent a monovalent hydrocarbon group having 1 or more and 12 or less carbon atoms, particularly preferably a hydrocarbon group having 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, and a n-octyl group.

(E104)

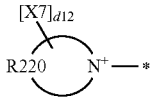

In the structural formula (E104), R220 represents a hydrocarbon group needed for forming a nitrogen-containing heteroaromatic ring in the structural formula (E104). d12 represents an integer of 1 or 2.

X7's each independently represent a monovalent hydrocarbon group having 1 or more and 12 or less carbon atoms, or a bonding site with the resin. At least one of X7's represents a bonding site with the resin. Symbol. "*" represents a bonding site with any one of the structural formulae (7) to (12).

The structural formula (E104) specifically represents an aromatic cation structure having a bonding site with the resin and containing one nitrogen atom in a ring structure. The ring structure is preferably a four- to seven-membered ring, particularly preferably a five-membered ring or a six-membered ring. Examples of such ring structure include a pyrrole ring, a pyridine ring, and an azepine ring.

X7 constituting a bonding site with the resin is described later.

Meanwhile, X7 not constituting a bonding site with the resin represents a hydrocarbon group having 1 or more and 12 or less carbon atoms, particularly preferably a hydrocarbon group having 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, and a n-octyl group.

(E105)

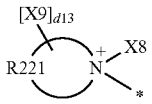

In the structural formula (E105), R221 represents a hydrocarbon group needed for forming a nitrogen-containing heterocyclic nonaromatic ring in the structural formula (E105). d13 represents an integer of 0 to 2.

X8 represents a hydrogen atom, a monovalent hydrocarbon group having 1 or more and 12 or less carbon atoms, or a bonding site with the resin. X9's each independently represent a monovalent hydrocarbon group having 1 or more and 12 or less carbon atoms, or a bonding site with the resin. At least one of X8 and X9's represents a bonding site with the resin. Symbol "*" represents a bonding site with any one of the structural formulae (7) to (12).

The structural formula (E105) specifically represents a nonaromatic cation structure having a bonding site with the resin and containing one nitrogen atom in a ring structure. The ring structure is preferably a four- to seven-membered ring, particularly preferably a five-membered ring or a six-membered ring. Specific examples of such ring structure include a pyrrolidine ring, a pyrroline ring, a piperidine ring, an azepane ring, and an azocane ring.

X8 or X9 constituting a bonding site with the resin is described later.

Meanwhile, X8 not constituting a bonding site with the resin specifically represents a hydrogen atom, or a monovalent hydrocarbon group having 1 or more and 12 or less carbon atoms. The hydrocarbon group is particularly preferably a monovalent hydrocarbon group having 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, a n-octyl group, a n-decyl group, and a n-dodecyl group.

In addition, when a plurality of X9's not constituting a bonding site with the resin are present, the plurality of X9's each independently represent a monovalent hydrocarbon group having 1 or more and 12 or less carbon atoms, particularly preferably a hydrocarbon group having 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, and a n-octyl group.

(E106)

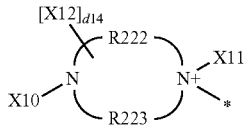

In the structural formula (E106), R222 and R223 each independently represent a hydrocarbon group needed for forming a nitrogen-containing heterocyclic nonaromatic ring in the structural formula (E106). d14 represents an integer of 0 to 2.

X10 and X11 each independently represent a hydrogen atom, a monovalent hydrocarbon group having 1 or more and 12 or less carbon atoms, or a bonding site with the resin.

X12's each independently represent a monovalent hydrocarbon group having 1 or more and 12 or less carbon atoms, or a bonding site with the resin. At least one of X10 to X12's represents a bonding site with the resin. Symbol "*" represents a bonding site with any one of the structural formulae (7) to (12).

The structural formula (E106) specifically represents a nonaromatic cation structure having a bonding site with the resin and containing two nitrogen atoms in a ring structure. The ring structure is preferably a four- to seven-membered ring, particularly preferably a five-membered ring or a six-membered ring. Specific examples of such ring structure include an imidazolidine ring, an imidazoline ring, a piperazine ring, a diazepane ring, and a diazocane ring.

X10 to X12 constituting a bonding site with the resin are described later.

Meanwhile, X10 and X11 not constituting a bonding site with the resin each specifically represent a hydrogen atom, or a monovalent hydrocarbon group having 1 or more and 12 or less carbon atoms. The hydrocarbon group is particularly preferably a monovalent hydrocarbon group having 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, and a n-octyl group.

When a plurality of X12's not constituting a bonding site with the resin are present, the plurality of X12's each independently represent a monovalent hydrocarbon group having 1 or more and 12 or less carbon atoms, particularly preferably a hydrocarbon group having 1 or more and 8 or less carbon atoms. Specific examples of such hydrocarbon group include a methyl group, an ethyl group, a n-propyl group, an isopropyl group, a n-butyl group, an isobutyl group, a t-butyl group, a n-hexyl group, and a n-octyl group.

(Method of Forming Resin Layer)

The resin having the cation groups and the anion are obtained by allowing the following components to react with each other:

(i) a compound having fluoroalkylsulfonylimide groups or fluorosulfonylimide groups bonded to both terminals of a chemical structure serving as a spacer between the cation groups;

(ii) a tertiary amine or a nitrogen-containing heterocyclic compound having a reactive functional group; and (iii) a resin or a resin raw material having a functional group capable of reacting with the reactive functional group.

As described in the first embodiment, through a reaction between the compound (i) and the compound (ii), an ionic electroconductive agent is generated. In addition, when a reaction between the reactive functional group in the compound (ii) and the functional group in the resin or the resin raw material proceeds, the cation groups derived from the compound (ii) are incorporated into the resin.

Specific examples of the compound (i) include those described in the first embodiment.

In the compound (ii), examples of the reactive functional group of the amine or the nitrogen-containing heterocyclic compound may include a hydroxy group, an amino group, and an epoxy group. Meanwhile, in the compound (iii), examples of the functional group of the resin or the resin raw material capable of reacting with the reactive functional group of the amine or the nitrogen-containing heterocyclic compound may include an isocyanate group, an epoxy group, a carboxyl group, and an amino group. The isocyanate group may be a blocked isocyanate group, which is protected by a blocking agent in a normal state but from which the blocking agent is removed at the time of a reaction.

In X1 to X12 in the structural formulae (E101) to (E106), the bonding site with the resin is a site formed through a reaction between the reactive functional group of the compound (ii), such as a hydroxy group, an amino group, or an epoxy group, and the reactive functional group of the compound (iii), such as an isocyanate group, an epoxy group, a carboxyl group, or an amino group.

A specific example of the compound (ii) is a compound represented by any one selected from the group consisting of the following structural formulae (E101') to (E106').

(E101')

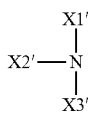

In the structural formula (E101'), X1' to X3' each independently represent a monovalent hydrocarbon group having 1 or more and 12 or less carbon atoms, or a hydrocarbon group having bonded thereto a reactive functional group, and at least one of X1' to X3' represents a hydrocarbon group having bonded thereto a reactive functional group.

Specific examples of the compound represented by the structural formula (E101') include dimethylethanolamine, diethylethanolamine, N-methyldiethanolamine, 4-dimethylamino-1-butanol, 6-dimethylamino-1-hexanol, 8-dimethylamino-1-octanol, 3-diethylamino-1-propanol, triethanolamine, tris(4-hydroxybutyl)amine, 2-dimethylaminoethylamine, 2-diethylaminoethylamine, 2-(dibutylamino)ethylamine, tris(2-aminoethyl)amine, N-glycidyl-dimethylamine, N-glycidyl-diethylamine, and N-glycidyl-di-n-butylamine.

(E102')

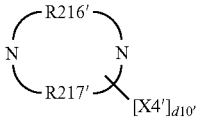

In the structural formula (E102'), R216' and R217' each independently represent a hydrocarbon group needed for forming a nitrogen-containing heteroaromatic six-membered ring in the structural formula (E102'), X4''s each independently represent a monovalent hydrocarbon group having 1 or more and 12 or less carbon atoms, or a hydrocarbon group having bonded thereto a reactive functional group, d10' represents an integer of 1 or 2, and at least one of X4''s represents a hydrocarbon group having bonded thereto a reactive functional group. Examples of the nitrogen-containing heteroaromatic six-membered ring include a pyrazine ring and a pyrimidine ring.

Specific examples of the compound represented by the structural formula (E102') include 2-pyrazinemethanol, 2-(2-hydroxyethyl)pyrazine, 2-(aminomethyl)pyrazine, 2-(aminomethyl)-5-methylpyrazine, 2-glycidylpyrazine, 2-hydroxyethylpyrimidine, 5-hydroxyethylpyrimidine, 2-aminoethylpyrimidine, 5-aminoethylpyrimidine, and 5-glycidylpyrimidine.

(E103')

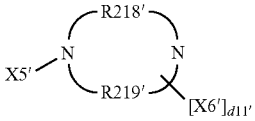

In the structural formula (E103'), R218' and R219' each independently represent a hydrocarbon group needed for forming a nitrogen-containing heteroaromatic five-membered ring in the structural formula (E103'), X5' represents a hydrogen atom, a monovalent hydrocarbon group having 1 or more and 12 or less carbon atoms, or a hydrocarbon group having bonded thereto a reactive functional group, X6''s each independently represent a monovalent hydrocarbon group having 1 or more and 12 or less carbon atoms, or a hydrocarbon group having bonded thereto a reactive functional group, d11' represents an integer of 0 to 2, and at least one of X5' and X6''s represents a hydrocarbon group having bonded thereto a reactive functional group. An example of the nitrogen-containing heteroaromatic five-membered ring is an imidazole ring.

Specific examples of the compound represented by the structural formula (E103') include 1-methyl-2-hydroxymethylimidazole, 1-methyl-2-hydroxyethylimidazole, 1-methyl-2-aminoethylimidazole, and 1,4-diglycidylimidazole.

(E104')

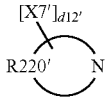

In the structural formula (E104'), R220' represents a hydrocarbon group needed for forming a nitrogen-containing heteroaromatic ring in the structural formula (E104'), X7''s each independently represent a monovalent hydrocarbon group having 1 or more and 12 or less carbon atoms, or a hydrocarbon group having bonded thereto a reactive functional group, d12' represents an integer of 1 or 2, and at least one of X7''s represents a hydrocarbon group having bonded thereto a reactive functional group. The ring structure of the nitrogen-containing heteroaromatic ring is preferably a four- to seven-membered ring, particularly preferably a five-membered ring or a six-membered ring.

Specific examples of the compound represented by the structural formula (E104') include 2-hydroxyethyl-5-ethylpyridine, 2-methyl-6-hydroxyethylpyridine, 2,6-pyridinedimethanol, 2-(2-aminoethyl)pyridine, and 5-ethyl-3-glycidyl-2-methylpyridine.

(E105')

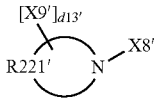

In the structural formula (E105'), R221' represents a hydrocarbon group needed for forming a nitrogen-containing heterocyclic nonaromatic ring in the structural formula (E105'), X8' represents a hydrogen atom, a monovalent hydrocarbon group having 1 or more and 12 or less carbon atoms, or a hydrocarbon group having bonded thereto a reactive functional group, X9''s each independently represent a monovalent hydrocarbon group having 1 or more and 12 or less carbon atoms, or a hydrocarbon group having bonded thereto a reactive functional group, d13' represents an integer of 0 to 2, and at least one of X8' and X9''s represents a hydrocarbon group having bonded thereto a reactive functional group. The ring structure of the nitrogen-containing heterocyclic nonaromatic ring is preferably a four- to seven-membered ring, particularly preferably a five-membered ring or a six-membered ring. Examples of the nitrogen-containing heterocyclic nonaromatic ring include a pyrrolidine ring, a pyrroline ring, a piperidine ring, an azepane ring, and an azocane ring.

Specific examples of the compound represented by the structural formula (E105') include 2-(2-hydroxyethyl)-1-methylpyrrolidine, 2-(2-aminoethyl)-1-methylpyrrolidine, 1-(2-aminoethyl) pyrrolidine, 1-(2-hydroxyethyl)-2-hydroxy methylpyrrolidine, 1-(2-hydroxyethyl)piperidine, 1-(2-hydroxyethyl)-2-hydroxymethylpiperidine, 1-(2-aminoethyl)piperidine, 1-(3-aminopropyl)-2-methylpiperidine, 1-(3-hydroxypropyl)azepane, and 2-glycidyl-1-methylpyrrolidine.

(E106')

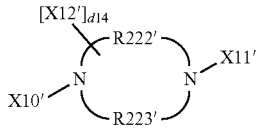

In the structural formula (E106'), R222' and R223' each independently a hydrocarbon group needed for forming a nitrogen-containing heterocyclic nonaromatic ring in the structural formula (E106'), X10' and X11' each independently represent a hydrogen atom, a monovalent hydrocarbon group having 1 or more and 12 or less carbon atoms, or a hydrocarbon group having bonded thereto a reactive functional group, X12''s each independently represent a monovalent hydrocarbon group having 1 or more and 12 or less carbon atoms, or a hydrocarbon group having bonded thereto a reactive functional group, d14' represents an integer of 0 to 2, and at least one of X10' to X12''s represents a hydrocarbon group having bonded thereto a reactive functional group. The ring structure of the nitrogen-containing heterocyclic nonaromatic ring is preferably a four- to seven-membered ring, particularly preferably a five-membered ring or a six-membered ring. Examples of the nitrogen-containing heterocyclic nonaromatic ring include an imidazolidine ring, an imidazoline ring, a piperazine ring, a diazepane ring, and a diazocane ring.

Specific examples of the compound represented by the structural formula (E106') include N-(2-hydroxyethyl)piperazine, N-(2-aminoethyl) piperazine, 1,4-bis(2-hydroxyethyl)piperazine, 1,4-bis(3-aminopropyl) piperazine, 4-methylpiperazine-1-ethanol, and N-methyl-2-glycidylpiperazine.

A specific example of the compound (iii) is a compound obtained by bonding the functional group capable of reacting with the reactive functional group to the resin or the resin raw material described in the first embodiment.

The following linkages are each preferred as a linkage which may be generated through the reaction between the reactive functional group in the amine or the nitrogen-containing heterocyclic compound, and the functional group capable of reacting with the reactive functional group.

(X101)

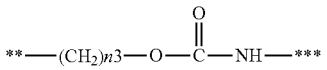

(X102)

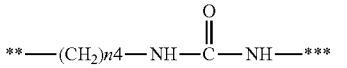

(X103)

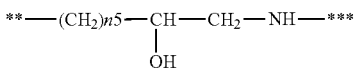

-continued (X104)

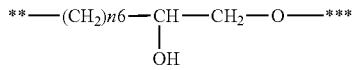

(X105)

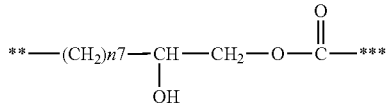

In the structural formulae (X101) to (X105), symbol "" represents a bonding site with a nitrogen atom in the structural formulae (E101), or represents a bonding site with one of a nitrogen atom in a nitrogen-containing heterocycle and a carbon atom in the nitrogen-containing heterocycle in any one of the structural formulae E(102) to (E106), symbol "*" represents a bonding site with a carbon atom in a polymer chain forming the resin, and n3 to n7 each independently represent an integer of 1 or more and 4 or less.

The linkage represented by the structural formula (X101) is formed through, for example, a reaction between a hydroxy group in the tertiary amine or the nitrogen-containing heterocyclic compound, and an isocyanate group in the resin or the resin raw material.

The linkage represented by the structural formula (X102) is formed through, for example, a reaction between an amino group in the tertiary amine or the nitrogen-containing heterocyclic compound, and an isocyanate group in the resin or the resin raw material.

The linkage represented by the structural formula (X103) is formed through, for example, a reaction between a glycidyl group in the tertiary amine or the nitrogen-containing heterocyclic compound, and an amino group in the resin or the resin raw material.

The linkage represented by the structural formula (X104) represents a moiety formed through, for example, a reaction between a glycidyl group in the tertiary amine or the nitrogen-containing heterocyclic compound, and a hydroxy group in the resin or the resin raw material.

The linkage represented by the structural formula (X105) is formed through, for example, a reaction between a glycidyl group in the tertiary amine or the nitrogen-containing heterocyclic compound, and a carboxyl group in the resin or the resin raw material.

An example of a combination of the above-mentioned compounds (i) to (iii) is described below. When N,N,N',N'-tetra(trifluoromethanesulfonyl)-1,6-diamine and triethanolamine are used as the compound (i) and the compound (ii), respectively, and the compounds are mixed with a raw material for a thermosetting polyurethane resin containing a polyisocyanate compound, followed by thermal curing, a urethane resin having a structure shown below may be obtained. The compound represented by the following structural formula is a compound represented by the structural formula (7), and its bonding sites with the resin each correspond to the structure represented by the structural formula (X101).

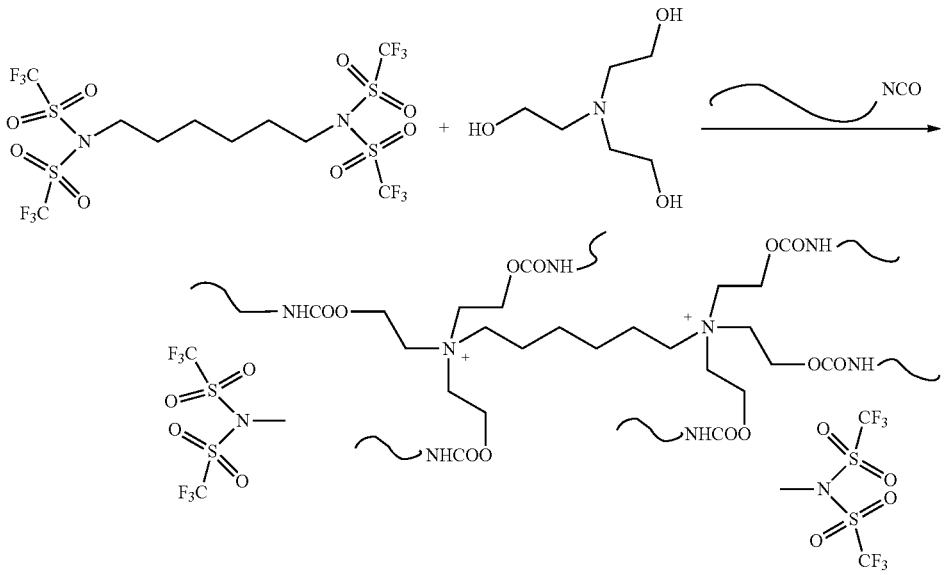

The resin layer 3 may be formed by heating a mixture of all of the compounds (i) to (iii) to simultaneously cure the compounds, or may be formed by subjecting the compound (i) and the compound (ii) to a reaction in advance to generate an ionic electroconductive agent, and then mixing the ionic electroconductive agent with the compound (iii), followed by curing. In the latter case, a thermosetting polyether-polyurethane resin or a thermosetting polyester-polyurethane resin is preferably used as the compound (iii).

The total content of the cation groups and the anion is preferably 0.1 part by mass or more and 10 parts by mass or less with respect to 100 parts by mass of the resin having a functional group capable of reacting with the reactive functional group. When the content falls within the range, the electroconductivity of the electrophotographic member is satisfactory even under a low-temperature environment, and an electrophotographic member achieving a high effect on deformation recoverability can be obtained.

(2) Electrophotographic Apparatus

The above-mentioned electrophotographic member according to the present invention may be suitably used as each of a developing roller, a toner feed roller, and a developing blade in an electrophotographic apparatus. The electrophotographic member may be applied to any of the following developing apparatus: a noncontact-type developing apparatus and a contact-type developing apparatus each using magnetic one-component toner or nonmagnetic one-component toner, and a developing apparatus using two-component toner.

Figure 3:
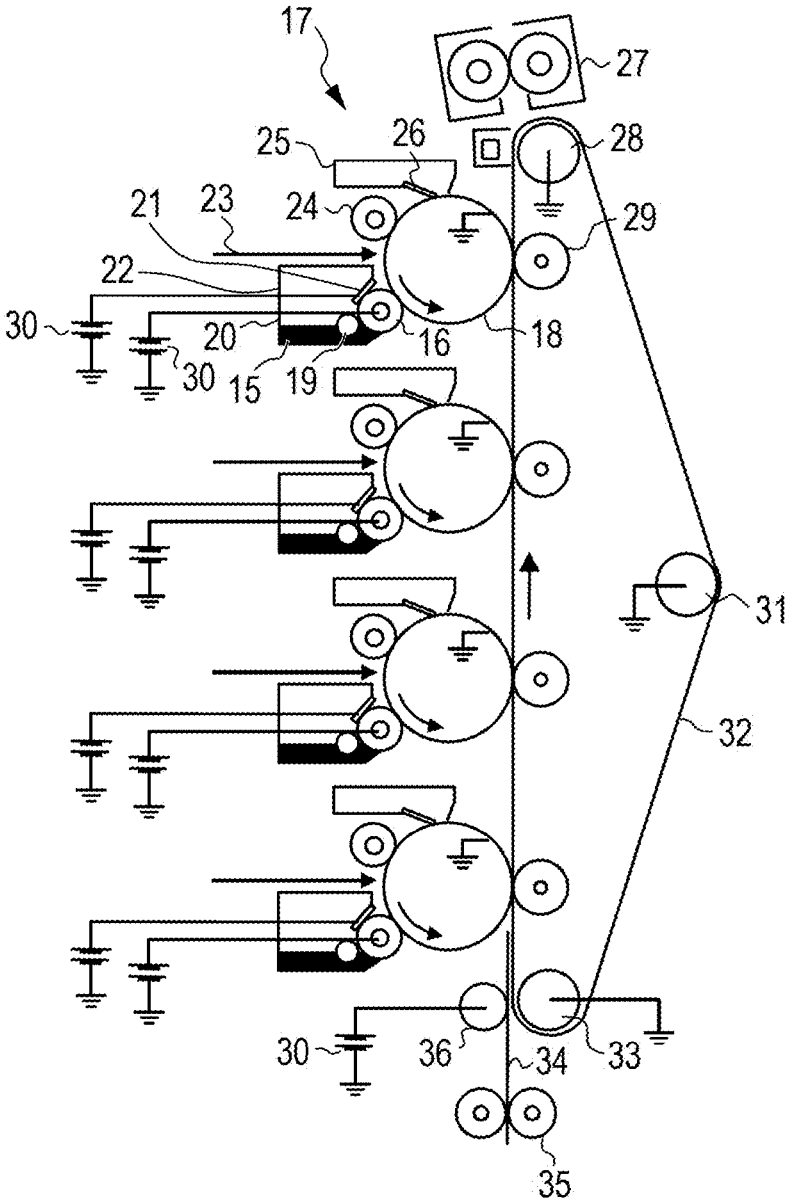
FIG. 3 is a schematic sectional view of an example of an electrophotographic apparatus according to one aspect of the present invention.

FIG. 3 is a schematic sectional view of an example of an electrophotographic apparatus including the electrophotographic member as a developing roller of a contact-type developing apparatus using one-component toner.

The electrophotographic apparatus has a developing apparatus 22 removably mounted thereonto. The developing apparatus 22 includes: a toner container 20 storing a toner 15 as the one-component toner; a developing roller 16; a toner feed roller 19 configured to supply the toner to the developing roller 16; and a developing blade 21 configured to regulate the thickness of a toner layer on the developing roller 16. The developing roller 16 is positioned in an opening portion extending in a longitudinal direction in the toner container 20 and is arranged so as to face the photosensitive member 18.

The electrophotographic apparatus also has a process cartridge 17 removably mounted thereonto, which includes the photosensitive member 18, a cleaning blade 26, a waste toner-storing container 25, and a charging roller 24. The photosensitive member 18, the cleaning blade 26, the waste toner-storing container 25, and the charging roller 24 may be arranged in the main body of the electrophotographic apparatus.

The printing operation of the electrophotographic apparatus is described below. The photosensitive member 18 rotates in a direction indicated by the arrow, and is uniformly charged by the charging roller 24 for subjecting the photosensitive member 18 to charging treatment. Subsequently, an electrostatic latent image is formed on the surface of the photosensitive member 18 by laser light 23 serving as an exposing unit. The toner 15 is applied to the electrostatic latent image by the developing apparatus 22, which is arranged so as to be brought into contact with the photosensitive member 18, to thereby visualize the image as a toner image (development). The development is the so-called reversal development in which the toner image is formed in an exposure portion. The toner image formed on the photosensitive member 18 is transferred onto paper 34 serving as a recording medium by a transfer roller 29 serving as a transfer member. The paper 34 is fed into the apparatus through a sheet-feeding roller 35 and an adsorption roller 36, and is conveyed to a gap between the photosensitive member 18 and the transfer roller 29 by an endless belt-shaped transfer conveyance belt 32. The transfer conveyance belt 32 is operated by a driven roller 33, a driver roller 28, and a tension roller 31. A voltage is applied from a bias power source 30 to each of the transfer roller 29 and the adsorption roller 36. The paper 34 onto which the toner image has been transferred is subjected to fixation treatment by a fixing apparatus 27 and discharged to the outside of the apparatus. Thus, a printing operation is completed.

Meanwhile, transfer residual toner remaining on the photosensitive member 18 without being transferred is scraped off by the cleaning blade 26 serving as a cleaning member for cleaning the surface of the photosensitive member, and is stored in the waste toner-storing container 25. The cleaned photosensitive member 18 repeatedly performs the above-mentioned action.

(3) Process Cartridge

The above-mentioned electrophotographic member according to the present invention may be suitably used as each of a developing roller, a toner feed roller, and a developing blade in a process cartridge.

Figure 4:
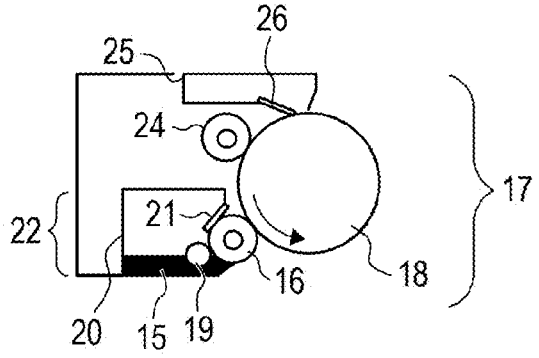
FIG. 4 is a schematic construction view of an example of a process cartridge according to one aspect of the present invention.

FIG. 4 is a schematic sectional view of an example of a process cartridge according to one aspect of the present invention. In FIG. 4, the electrophotographic member is mounted as the developing roller 16.

The process cartridge 17 illustrated in FIG. 4 is removably mounted onto the main body of an electrophotographic apparatus. The process cartridge 17 is obtained by integrating the developing apparatus 22, which includes the developing roller 16 and the developing blade 21, the electrophotographic photosensitive member 18, the cleaning blade 26, the waste toner-storing container 25, and the charging roller 24. The developing apparatus 22 further includes the toner container 20, and the toner 15 is loaded into the toner container 20. The toner 15 in the toner container 20 is supplied to the surface of the developing roller 16 by the toner feed roller 19, and a layer of the toner 15 having a predetermined thickness is formed on the surface of the developing roller 16 by the developing blade 21.

According to one aspect of the present invention, the electrophotographic member which hardly undergoes deformation even when subjected to a load over a long period of time under a high-temperature and high-humidity environment and thus can stably form a high-quality electrophotographic image can be obtained. In addition, according to other aspects of the present invention, the process cartridge and the electrophotographic apparatus each capable of stably forming a high-quality electrophotographic image can be obtained.

Now, specific Examples and Comparative Examples according to the present invention are described.

First, raw material compounds needed for producing ionic electroconductive agents and resins were synthesized.

<Synthesis of Compound (1)>

(Synthesis of Compound IP-1)

16.0 g (0.13 mol) of 1,4-dichlorobutane (manufactured by Tokyo Chemical Industry Co., Ltd.) and 79.5 g (0.28 mol) of lithium bis(trifluoromethanesulfonyl)imide (trade name: "EF-N115"; manufactured by Mitsubishi Materials Electronic Chemicals Co., Ltd.) were supplied as a raw material No. 1 and a raw material No. 2, respectively. The raw materials were dissolved in 60.0 g of chloroform, and the solution was heated to reflux for 5 hours. Next, the reaction solution was cooled to room temperature, and 200 ml of a 5 mass % aqueous solution of sodium carbonate was added. The mixture was stirred for 30 minutes and then subjected to liquid separation. The chloroform layer was subjected to a washing operation three times with 120 g of ion-exchanged water. Next, chloroform was removed by evaporation under reduced pressure to provide a compound IP-1. The compound IP-1 is a compound represented by the following formula (21).

(21)

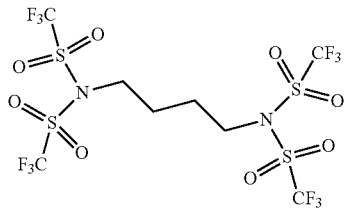

(Synthesis of Compounds IP-3, 5, 6, 7, and 10)

Compounds IP-3, 5, 6, 7, and 1.0 were obtained in the same manner as in the synthesis example of the synthesis of the compound IP-1 except that the raw material No. 1 and the raw material No. 2, and their blending amounts were changed as shown in Table.

(Synthesis of Compound IP-2)

16.0 g (0.14 mol) of 3-methyl-1, 5-pentanediol (manufactured by Tokyo Chemical Industry Co., Ltd.) and 83.5 g (0.30 mol) of 1,1,1-trifluoro-N-[(trifluoromethyl)sulfonyl] methanesulfonamide (manufactured by Kanto Chemical Co., Inc.) were supplied as a raw material No. 1 and a raw material No. 2, respectively. The raw materials were dissolved in 60.0 g of chloroform, and the solution was heated to reflux for 5 hours. Next, the reaction solution was cooled to room temperature, and 200 ml of a 5 mass % aqueous solution of sodium carbonate was added. The mixture was stirred for 30 minutes and then subjected to liquid separation. The chloroform layer was subjected to a washing operation three times with 120 g of ion-exchanged water. Next, chloroform was removed by evaporation under reduced pressure to provide a compound IP-2. The compound IP-2 is a compound represented by the following structural formula (22).

(22)

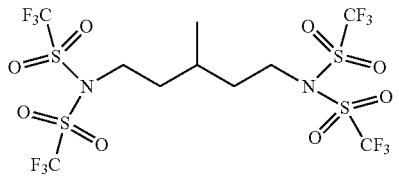

(Synthesis of Compounds IP-4, 8, 9, 11, and 12)

Compounds IP-4, 8, 9, 11, and 12 were obtained in the same manner as in the synthesis example of the synthesis of the compound IP-2 except that the raw material No. 1 and the raw material No. 2, and their blending amounts were changed as shown in Table 1.

TABLE 1

| No. | Raw material No. 1 Product name | Weight (g) | Raw material No. 2 Product name | Weight (g) |
|---|---|---|---|---|
| IP-1 | 1,4-Dichlorobutane (manufactured by Tokyo Chemical Industry Co., Ltd.) | 16.0 | Lithium N,N-bis(trifluoromethanesulfonyl)imide (trade name: EF-N115; manufactured by Mitsubishi Materials Electronic Chemicals Co., Ltd.) | 79.5 |
| IP-2 | 3-Methyl-1,5-pentanediol (manufactured by Tokyo Chemical Industry Co., Ltd.) | 16.0 | 1,1,1-Trifluoro-N-[(trifluoromethyl)sulfonyl]methanesulfonamide (manufactured by Kanto Chemical Co., Inc.) | 83.5 |
| IP-3 | 1,6-Dichlorohexane (manufactured by Tokyo Chemical Industry Co., Ltd.) | 20.0 | Lithium N,N-bis(trifluoromethanesulfonyl)imide (trade name: EF-N115; manufactured by Mitsubishi Materials Electronic Chemicals Co., Ltd.) | 81.5 |
| IP-4 | 1,16-Hexadecanediol (manufactured by Tokyo Chemical Industry Co., Ltd.) | 17.0 | N,N-Bis(nonafluorobutanesulfonyl)imide (trade name: EF-N4415-30; manufactured by Mitsubishi Materials Electronic Chemicals Co., Ltd.) | 84.2 |
| IP-5 | 1,4-Dichloro-2-butene (manufactured by Tokyo Chemical Industry Co., Ltd.) | 21.0 | Potassium N,N-bis(fluorosulfonyl)imide (trade name: K-FSI; manufactured by Mitsubishi Materials Electronic Chemicals Co., Ltd.) | 80.9 |
| IP-6 | 1,4-Bis(2-chloroethyl)benzene (manufactured by Tokyo Chemical Industry Co., Ltd.) | 22.0 | Potassium N,N-hexafluropropane-1,3-disulfonylimide (trade name: EF-N302; manufactured by Mitsubishi Materials Electronic Chemicals Co., Ltd.) | 78.9 |
| IP-7 | α,α'-Dichloro-m-xylene (manufactured by Tokyo Chemical Industry Co., Ltd.) | 22.0 | Lithium N,N-bis(trifluoromethanesulfonyl)imide (trade name: EF-N115; manufactured by Mitsubishi Materials Electronic Chemicals Co., Ltd.) | 79.4 |
| IP-8 | 1,4-Cyclohexane dimethanol (manufactured by Tokyo Chemical Industry Co., Ltd.) | 19.0 | 1,1,1-Trifluoro-N-[(trifluoromethyl)sulfonyl]methanesulfonamide (manufactured by Kanto Chemical Co., Inc.) | 81.3 |
| IP-9 | Tetraethylene glycol (manufactured by Tokyo Chemical Industry Co., Ltd.) | 13.0 | N,N-bis(nonafluoromethanesulfonyl)imide (trade name: EF-N441S-30; manufactured by Mitsubishi Materials Electronic Chemicals Co., Ltd.) | 85.7 |
| IP-10 | Bis(4-chlorobutyl)ether (manufactured by Tokyo Chemical Industry Co., Ltd.) | 28.0 | Potassium N,N-bis(fluorosulfonyl)imide (trade name: K-FSI; manufactured by Mitsubishi Materials Electronic Chemicals Co., Ltd.) | 67.8 |
| IP-11 | Triethanolamine (manufactured by Tokyo Chemical Industry Co., Ltd.) | 20.0 | 1,1,1-Trifluoro-N-[(trifluoromethyl)sulfonyl]methanesulfonamide (manufactured by Kanto Chemical Co., Inc.) | 82.7 |
| IP-12 | Diethanolamine (manufactured by Tokyo Chemical Industry Co., Ltd.) | 15.0 | 1,1,1-Trifluoro-N-[(trifluoromethyl)sulfonyl]methanesulfonamide (manufactured by Kanto Chemical Co., Inc.) | 86.0 |

<Synthesis of Compound (ii)>

(Synthesis of Glycidyl Group-Containing Compound Z-1)

50.0 g (0.41 mol) of 5-ethyl-2-methylpyridine (manufactured by Tokyo Chemical Industry Co., Ltd.) was dissolved in 90.0 g of dichloromethane. To this solution, a mixed solution formed of 42.0 g (0.45 mol) of chloromethyloxirane (manufactured by Tokyo Chemical Industry Co., Ltd.) (glycidylating reagent) dissolved in 80.0 g of dichloromethane and 1.8 g of aluminum chloride serving as a catalyst was added, and then the mixture was heated to reflux for 8 hours.

Next, the reaction solution was cooled to 10° C., 50.0 g of 4 mol/L hydrochloric acid was added, and the mixture was stirred for 30 minutes. After that, the dichloromethane layer was subjected to liquid separation, and further subjected to a washing operation three times with 120 g of ion-exchanged water. Next, dichloromethane was removed by evaporation under reduced pressure to provide a compound Z-1. The compound Z-1 is a compound represented by the following structural formula (23).

(23)

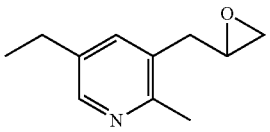

(Synthesis of Glycidyl Group-Containing Compound Z-2)

22.0 g (0.32 mol) of imidazole (manufactured by Tokyo Chemical. Industry Co., Ltd.) was dissolved in 50.0 g of dichloromethane. To this solution, a mixed solution formed of 32.9 g (0.36 mol) of chloromethyloxirane (manufactured by Tokyo Chemical Industry Co., Ltd.) (glycidylating reagent) dissolved in 80.0 g of dichloromethane and 2.2 g of aluminum chloride serving as a catalyst was added, and then the mixture was heated to reflux for 6 hours.

Next, the reaction solution was cooled to 10° C., 50.0 g of 4 mol/L hydrochloric acid was added, and the mixture was stirred for 30 minutes. After that, the dichloromethane layer was subjected to liquid separation, and further subjected to a washing operation twice with 120 g of ion-exchanged water.

To the resultant solution, 35.9 g (0.39 mol) of chloromethyloxirane (manufactured by Tokyo Chemical Industry Co., Ltd.) (tertiarizing agent) dissolved in 50.0 g of dichloromethane was added dropwise over 30 minutes, and the mixture was heated to reflux for 8 hours. Next, the reaction solution was cooled to room temperature, and 200 ml of a 5 mass % aqueous solution of sodium carbonate was added. The mixture was stirred for 30 minutes and then subjected to liquid separation. The dichloromethane layer was washed twice with 120 g of ion-exchanged water. Next, dichloromethane was removed by evaporation under reduced pressure to provide a compound Z-2. The compound Z-2 is a compound represented by the following structural formula (24).

(24)

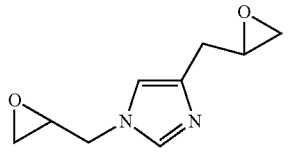

(Synthesis of Hydroxy Group-Containing Compound Z-3)

26.0 g (0.26 mol) of DL-prolinol (manufactured by Tokyo Chemical Industry Co., Ltd.), 42.1 g of potassium carbonate, and 38.6 g (0.31 mol) of 2-bromoethanol (manufactured by Tokyo Chemical Industry Co., Ltd.) were dissolved in 140 g of acetonitrile. The solution was stirred at 50° C. for 5 hours. After the completion of the reaction, the resultant was left to cool, and then an Inorganic salt was removed by suction filtration. The filtrate was concentrated under reduced pressure. To the residue, 300 mL of diethyl ether was added, and the mixture was thoroughly stirred. After that, the mixture was left to stand still for 20 minutes, and the supernatant was removed. A similar operation was performed three times with 100 mL of diethyl ether, and twice with 100 mL of acetonitrile. The resultant was vacuum-dried to provide a compound Z-3. The compound Z-3 is a compound represented by the following structural formula (25).

(25)

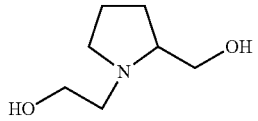

<Synthesis of Isocyanate Group-Terminated Prepolymer>

(Synthesis of Isocyanate Group-Terminated Prepolymer B-1)

Under a nitrogen atmosphere, 100.0 parts by mass of a polyether polyol (trade name: "PTG-L1000"; manufactured by Hodogaya Chemical Co., Ltd.) was gradually dropped to 81.1 parts by mass of polymeric MDI (trade name: "MILLIONATE MR-200"; manufactured by Tosoh Corporation) in a reaction vessel while a temperature in the reaction vessel was held at 65° C. After the completion of the dropping, the mixture was subjected to a reaction at a temperature of 65° C. for 3.5 hours, and 80.0 parts by mass of methyl ethyl ketone was added to the resultant. The resultant reaction mixture was cooled to room temperature to provide an isocyanate group-terminated urethane prepolymer B-1 having an isocyanate group content of 4.4 wt %.

(Synthesis of Isocyanate Group-Terminated Prepolymer B-2)

Under a nitrogen atmosphere, 100.0 parts by mass of a polycarbonate polyol (trade name: "Kuraray Polyol C-3090"; manufactured by Kuraray Co., Ltd.) was gradually dropped to 68.8 parts by mass of polymeric MDI (trade name: "MILLIONATE MR-200"; manufactured by Tosoh Corporation) in a reaction vessel while a temperature in the reaction vessel was held at 65° C. After the completion of the dropping, the mixture was subjected to a reaction at a temperature of 65° C. for 2.5 hours, and 80.0 parts by mass of methyl ethyl ketone was added to the resultant. The resultant reaction mixture was cooled to room temperature to provide an isocyanate group-terminated urethane prepolymer B-2 having an isocyanate group content of 5.0 wt %.

«Production and Evaluation of Developing Roller»

EXAMPLE 1

(Preparation of Substrate)

Prepared as the substrate was a product obtained by applying and baking a primer (trade name: "DY35-051"; manufactured by Dow Corning Toray Co., Ltd.) to a cored bar made of SUS304 having a diameter of 6 mm.

(Formation of Silicone Rubber Elastic Layer)

The substrate prepared in the foregoing was placed in a mold, and an addition-type silicone rubber composition obtained by mixing the following materials was injected into a cavity formed in the mold.

Liquid silicone rubber material (trade name: "SE6724A/B"; manufactured by Dow Corning Toray Co., Ltd.) 100.0 parts by mass Carbon black (trade name: "TOKABLACK #4300"; manufactured by Tokai Carbon Co., Ltd.) 15.0 parts by mass Platinum catalyst 0.1 part by mass Subsequently, the mold was heated, and the silicone rubber composition was vulcanized and cured at a temperature of 150° C. for 15 minutes. The substrate having a cured silicone rubber layer formed on its peripheral surface was removed from the mold, and then the curing reaction of the silicone rubber layer was completed by further heating the cored bar at a temperature of 180° C. for 1 hour. Thus, an elastic roller D-1 in which a silicone rubber elastic layer having a thickness of 3 mm had been formed on the outer periphery of the substrate 2 was produced.

(Formation of Resin Layer)

The following materials were mixed and stirred as materials for a resin layer.

Polyether polyol (trade name: "EXCENOL 500ED"; manufactured by Asahi Glass Co., Ltd.) 10.7 parts by mass Isocyanate group-terminated prepolymer B-1 127.6 parts by mass IP-1 as the compound (i) 0.66 part by mass N,N-Dimethyl-n-octylamine (manufactured by Tokyo Chemical Industry Co., Ltd.) as the compound (ii) 0.34 part by mass Silica (trade name: "AEROSIL 200"; manufactured by Nippon Aerosil Co., Ltd.) as the filler 10.0 parts by mass Urethane resin fine particles (trade name: "Art Pearl C-400"; manufactured by Negami Chemical Industrial Co., Ltd.) as the particles for roughness control 10.0 parts by mass Next, methyl ethyl ketone was added to the mixed solution so as to achieve a total solid content ratio of 30 mass %, and then the contents were mixed in a sand mill. Then, the viscosity of the mixture was further adjusted to from 10 cps to 12 cps with methyl ethyl ketone. Thus, a coating material for forming a resin layer was prepared.

A coating film of the coating material for forming a resin layer was formed on the surface of the elastic layer of the elastic roller D-1 produced in advance by immersing the elastic roller D-1 in the coating material, and was dried. Further, the resultant was subjected to heating treatment at a temperature of 150° C. for 1 hour to cure the coating material. Thus, a developing roller having a resin layer having a thickness of about 15 μm formed on the outer periphery of the elastic layer was produced.

(Component Analysis of Resin Layer)

The chemical structures of a cation, an anion, and a resin which are contained in the resin layer may be identified through, for example, analysis by pyrolysis GC/MS, FT-IR, or NMR.

The developing roller according to Example 1 was immersed in methyl ethyl ketone for 48 hours, and the extracted components were analyzed. Specifically, the analysis was performed by using a pyrolyzer (trade name: "PYROFOIL SAMPLER JPS-700"; manufactured by Japan Analytical Industry Co., Ltd.) and a GC/MS apparatus (trade name: "Focus GC/ISQ"; manufactured by Thermo Fischer Scientific K.K.), and helium as a carrier gas at a pyrolysis temperature of 590° C.

As a result, it was found from the resultant fragment peak that the resin layer contained an ionic electroconductive agent represented by the following structural formula (26), which was generated through a reaction between IP-1 serving as the compound (i) and N,N-dimethyl-n-octylamine serving as the compound (ii).

(26)

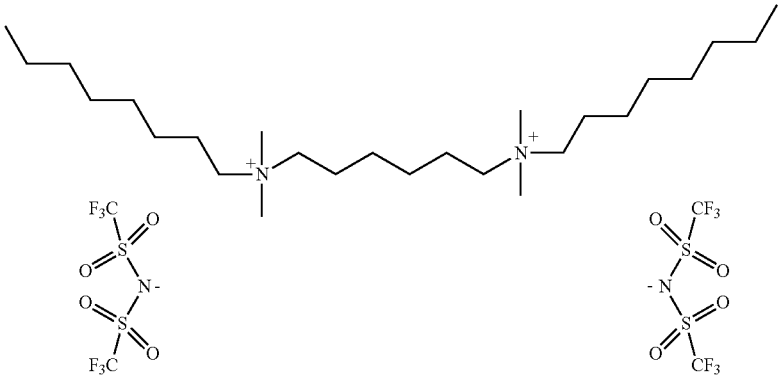

EXAMPLES 2 TO 5

Developing rollers according to Examples 2 to 5 were produced in the same manner as in Example 1 except that the compound (i) and the compound (ii), and their blending amounts were changed as shown in Table 2.

EXAMPLE 6

The following materials were mixed and stirred as materials for a resin layer.

| | |
|---|---|
| Polyether polyol "PTG-L1000" (trade name; manufactured by Hodogaya Chemical Co., Ltd.) | 35.3 parts by mass |
| Isocyanate group-terminated prepolymer B-1 | 80.8 parts by mass |
| IP-3 as the compound (i) | 3.54 parts by mass |
| 1-Butylpyrrolidine (manufactured by Sigma-Aldrich Co. LLC.) as the compound (ii) | 1.46 parts by mass |
| Silica (trade name: "AEROSIL 200"; manufactured by Nippon Aerosil Co., Ltd.) as the filler | 10.0 parts by mass |
| Urethane resin fine particles (trade name: "Art Pearl C-400"; manufactured by Negami Chemical Industrial Co., Ltd.) as the particles for roughness control | 10.0 parts by mass |

Next, methyl ethyl ketone was added to the mixed solution so as to achieve a total solid content ratio of 30 mass %, and then the contents were mixed in a sand mill. Next, the viscosity of the mixture was further adjusted to from 1.0 cps to 12 cps with methyl ethyl ketone. Thus, a coating material for forming a resin layer was prepared.

A developing roller according to Example 6 was produced in the same manner as in Example 1 except that this paint for forming a resin layer was used.

EXAMPLES 7 TO 10

Developing rollers according to Examples 7 to 10 were produced in the same manner as in Example 6 except that the compound (i) and the compound (ii), and their blending amounts were changed as shown in Table 2.

EXAMPLE 11

The following materials were mixed and stirred as materials for a resin layer.

| | |
|---|---|
| Polycarbonate polyol "Kuraray Polyol C-3090" (trade name; manufactured by Kuraray Co., Ltd.) | 65.3 parts by mass |
| Isocyanate group-terminated prepolymer B-2 | 43.4 parts by mass |
| IP-7 as the compound (i) | 2.21 parts by mass |
| 2-Pyrazinemethanol (manufactured by Tokyo Chemical Industry Co., Ltd.) as the compound (ii) | 0.79 parts by mass |
| Silica (trade name: "AEROSIL 200"; manufactured by Nippon Aerosil Co., Ltd.) as the filler | 10.0 parts by mass |
| Urethane resin fine particles (trade name: "Art Pearl C-400"; manufactured by Negami Chemical Industrial Co., Ltd.) as the particles for roughness control | 10.0 parts by mass |

IP-7 is a compound represented by the following structural formula (27), and 2-pyrazinemethanol is a compound represented by the following structural formula (28).

(27)

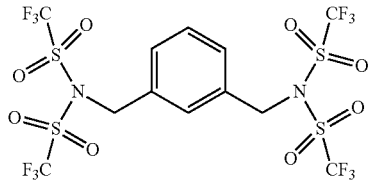

-continued (28)

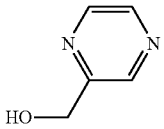

Next, methyl ethyl ketone was added to the mixed solution so as to achieve a total solid content ratio of 30 mass %, and then the contents were mixed in a sand mill. Then, the viscosity of the mixture was adjusted to from 10 cps to 12 cps with methyl ethyl ketone. Thus, a coating material for forming a resin layer was prepared.

A developing roller according to Example 11 was produced in the same manner as in Example 1 except that this paint for forming a resin layer was used.

Part of the resin layer in the developing roller according to Example 11 was subjected to pyrolysis GC/MS analysis in the same manner as in Example 1. As a result, it was found that the resin layer contained a compound represented by the following structural formula (29), which was generated through a reaction among IP-7 serving as the compound (i), 2-pyrazinemethanol serving as the compound (ii), and the isocyanate group-terminated prepolymer B-2.

(29)

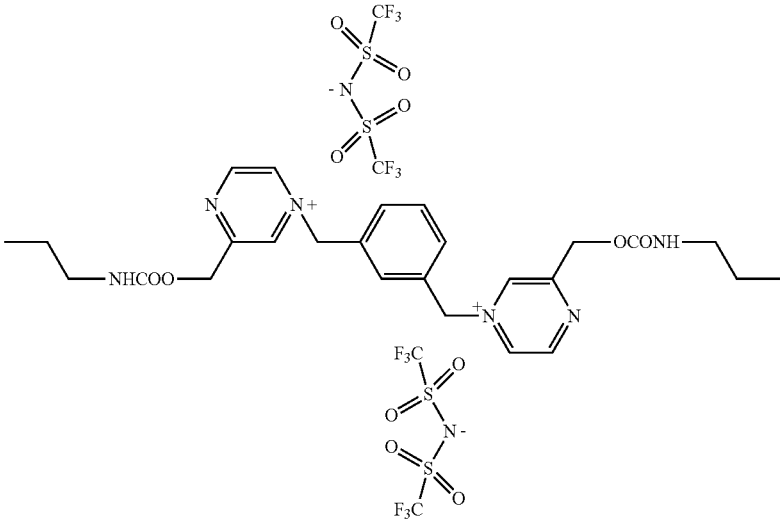

EXAMPLES 12 TO 18

Developing rollers according to Examples 12 to 18 were produced in the same manner as in Example 11 except that the compound (i) and the compound (ii), and their blending amounts were changed as shown in Table 2.

TABLE 2

| | Raw material compound | | | | | Binder resin | | | |
|---|---|---|---|---|---|---|---|---|---|
| | Compound (i) | | Compound (ii) | | | Main agent | | Curing agent | |
| | No. | part(s) by mass | No. | Compound name | part(s) by mass | No. | part(s) by mass | No. | part(s) by mass |
| Example 1 | IP-1 | 0.66 | CT-1 | N,N-Dimethyl-n-octylamine (manufactured by Tokyo Chemical Industry Co., Ltd.) | 0.34 | EXCENOL 500ED | 10.7 | B-1 | 127.6 |
| Example 2 | IP-2 | 0.70 | CT-2 | 5-Ethyl-2,3-dimethylpyrazine (manufactured by Tokyo Chemical Industry Co., Ltd.) | 0.30 | | | | |
| Example 3 | IP-6 | 0.79 | CT-3 | 1,2-Dimethylimidazole (manufactured by Tokyo Chemical Industry Co., Ltd.) | 0.21 | | | | |
| Example 4 | IP-8 | 0.65 | CT-4 | 1-Octylimidazole (manufactured by Sigma-Aldrich Co. LLC.) | 0.35 | | | | |
| Example 5 | IP-9 | 0.85 | CT-5 | 2-Methyl-5-ethyl-pyridine (manufactured by Tokyo Chemical Industry Co., Ltd.) | 0.15 | | | | |
| Example 6 | IP-3 | 3.54 | CT-6 | 1-Butylpyrrolidine (manufactured by Sigma-Aldrich Co. LLC.) | 1.46 | PTG-L1000 | 35.3 | B-1 | 80.8 |

TABLE 2-continued

| | Raw material compound | | | | | Binder resin | | | |
|---|---|---|---|---|---|---|---|---|---|
| | Compound (i) | | Compound (ii) | | | Main agent | | Curing agent | |
| | No. | part(s) by mass | No. | Compound name | part(s) by mass | No. | part(s) by mass | No. | part(s) by mass |
| Example 7 | IP-12 | 2.70 | CT-7 | 1-Dodecylazepane (manufactured by Sigma-Aldrich Co. LLC.) | 2.30 | | | | |
| Example 8 | IP-11 | 3.73 | CT-8 | N,N'-Dimethylpiperazine (manufactured by Tokyo Chemical Industry Co., Ltd.) | 1.27 | | | | |
| Example 9 | IP-5 | 2.72 | CT-9 | 8-Dimethylamino-1-octanol (manufactured by Tokyo Chemical Industry Co., Ltd.) | 2.28 | | | | |
| Example 10 | IP-3 | 3.37 | CT-10 | Triethanolamine (manufactured by Tokyo Chemical Industry Co., Ltd.) | 1.63 | | | | |
| Example 11 | IP-7 | 2.21 | CT-11 | 2-Pyrazinemethanol (manufactured by Tokyo Chemical Industry Co., Ltd.) | 0.79 | C-3090 | 65.3 | B-2 | 43.4 |
| Example 12 | IP-8 | 2.18 | CT-12 | 1-Methyl-2-hydroxymethylimidazole (manufactured by Tokyo Chemical Industry Co., Ltd.) | 0.82 | | | | |
| Example 13 | IP-10 | 1.73 | CT-13 | Compound Z-2 (1,4-diglycidylimidazole) | 1.27 | | | | |
| Example 14 | IP-3 | 2.07 | CT-14 | 2,6-Pyridinedimethanol (manufactured by Tokyo Chemical Industry Co., Ltd.) | 0.93 | | | | |
| Example 15 | IP-12 | 1.92 | CT-15 | Compound Z-1 (5-ethyl-3-glycidyl-2-methylpridine) | 1.08 | | | | |
| Example 16 | IP-3 | 2.12 | CT-16 | 2-(2-Aminoethyl)-1-methylpyrrolidine (manufactured by Tokyo Chemical Industry Co., Ltd.) | 0.88 | | | | |
| Example 17 | IP-4 | 2.44 | CT-17 | Compound Z-3 (1-(2-hydroxyethyl)-2-(hydroxymethyl)pyrrolidine) | 0.56 | | | | |
| Example 18 | IP-11 | 1.88 | CT-18 | 1,4-Bis(3-aminopropyl)piperazine (manufactured by Tokyo Chemical Industry Co., Ltd.) | 1.12 | | | | |

COMPARATIVE EXAMPLE 1

A developing roller according to Comparative Example 1 was produced in the same manner as in Example 1 except that the compound (i) and the compound (ii) were not added.

COMPARATIVE EXAMPLES 2 TO 4

Developing rollers according to Comparative Examples 2 to 4 were produced in the same manner as in Example 1 except that ionic electroconductive agents shown in Table 3 below were added in place of the compound (i) and the compound (ii).

TABLE 3

| | Ionic electroconductive agent | | Binder resin | | | |
|---|---|---|---|---|---|---|
| | | | Main agent | | Curing agent | |
| | Compound name | part(s) by mass | No. | part(s) by mass | No. | part(s) by mass |
| Comparative Example 1 | — | — | EXCENOL 500ED | 10.7 | B-1 | 127.6 |
| Comparative Example 2 | Tributylmethylammonium bis(trifluoromethanesulfonyl)imide (manufactured by Tokyo Chemical Industry Co., Ltd.) | 1.0 | | | | |

TABLE 3-continued

| | Ionic electroconductive agent | | Binder resin | | |
|---|---|---|---|---|---|
| | | | Main agent | | Curing agent |
| | Compound name | part(s) by mass No. | | part(s) by mass No. | part(s) by mass |
| Comparative Example 3 | 1-Ethyl-3-methylimidazolium trifluoromethanesulfonate (manufactured by Tokyo Chemical Industry Co., Ltd.) | | | | |
| Comparative Example 4 | 1-Hexylpyridinium chloride (manufactured by Kanto Chemical Co., Inc.) | | | | |

<Evaluation of Developing Roller>

The developing rollers according to Examples 1 to 18 and Comparative Examples 1 to 4 thus obtained were each evaluated for the following items. The evaluation results are collectively shown in Table 4 and Table 5.

(Evaluation of Resistance Value of Roller)

The resistance value of the developing roller was measured under a low-temperature and low-humidity environment (temperature: 15° C., relative humidity: 10%) after the developing roller had been left to stand under the environment for 6 hours or more.

Figure 5A:
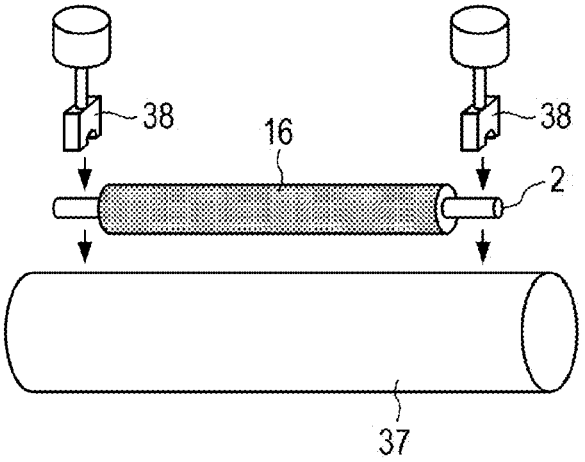
FIG. 5A and FIG. 5B are each a schematic construction view of a jig for evaluating the resistance value of a developing roller.
Figure 5B:
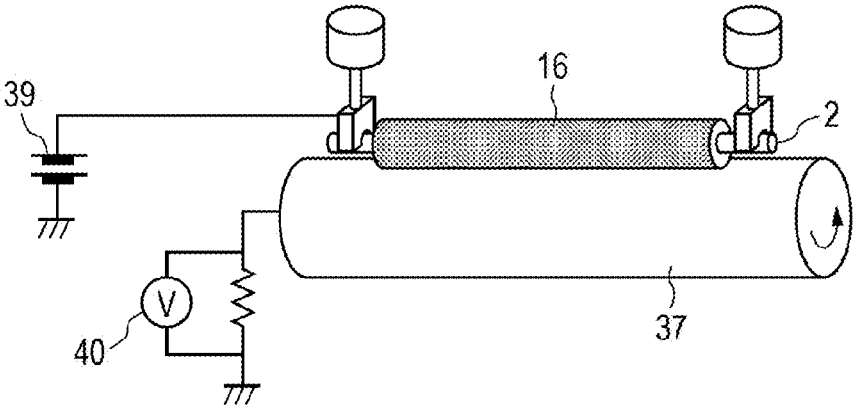

FIG. 5A and FIG. 5B are each a schematic construction view of a jig for evaluating the resistance value of a developing roller, to be used in this measurement. In FIG. 5A, while both ends of the electroconductive substrate 2 were each pressed with a load of 4.9 N through the intermediation of an electroconductive bearing 38, a columnar metal 37 having a diameter of 40 mm was rotated to rotationally drive the developing roller 16 at a speed of 60 rpm. Next, a voltage of 50 V was applied from a high-voltage power source 39, and a potential difference between both ends of a resistor having a known electrical resistance (having an electrical resistance lower than the electrical resistance of the developing roller 16 by two orders of magnitude or more) placed between the columnar metal 37 and the ground was measured. The potential difference was measured using a voltmeter 40 ("189TRUE RMS MULTIMETER"; manufactured by Fluke Corporation). A current which had flowed through the developing roller 16 into the columnar metal was determined by calculation based on the measured potential difference and the electrical resistance of the resistor. Then, the applied voltage of 50 V was divided by the resultant current to determine the resistance value of the developing roller 16.

In the measurement of the potential difference, 2 seconds after the application of the voltage, sampling was performed for 3 seconds and a value calculated from the average value of the sampled data was defined as a roller resistance value.

(Evaluation of L/L Ghost)

Next, the following evaluation was performed using the developing roller which had been subjected to the measurement of its resistance under the low-temperature and low-humidity environment (temperature: 15° C., relative humidity: 10%) as described above.

The developing roller was mounted onto a laser printer having the construction illustrated in FIG. 3 (trade name: "LBP7700C"; manufactured by Canon Inc.), and the laser printer was placed and left to stand for 2 hours under a low-temperature and low-humidity environment (temperature: 15° C., relative humidity: 10%). Then, evaluation of a ghost image was performed.

Specifically, as an image pattern, a 15 mm square solid black image was printed at a tip portion in one sheet by using a black toner, and then an entire halftone image was printed on the sheet by using the toner. Next, the density unevenness of the period of the developing roller appearing in a halftone portion was visually evaluated, and evaluation of a ghost was performed by the following criteria.

A: No ghost is observed.

B: An extremely slight ghost is observed.

C: A remarkable ghost is observed.

(Evaluation of Deformation Recoverability)

Figure 6:
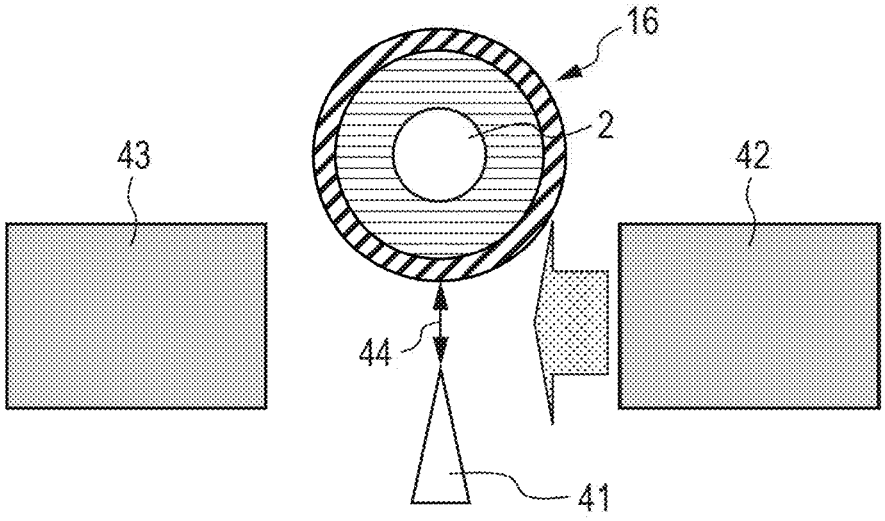
FIG. 6 is a schematic construction view of an apparatus for measuring the residual deformation amount of an electrophotographic roller.

Evaluation of deformation recoverability was performed using an apparatus illustrated in FIG. 6. This measurement apparatus includes: a substrate holder (not shown) configured to rotate with reference to the substrate 2; an encoder (not shown) configured to detect the rotation of the substrate 2; a reference plate 41; and a dimension-measuring machine (trade name: "LS-7000"; manufactured by Keyence Corporation) including a LED light-emitting part 42 and a light-receiving part 43.

First, a gap amount 44 between the surface of the developing roller 16 and the reference plate 41 was measured to determine the distance from the center of the developing roller 16 to its surface. The gap amount 44 between the surface of the developing roller 16 and the reference plate 41 was measured for each of the following three points in total: the central portion of the developing roller 16 in its longitudinal direction, and positions 20 mm away from both ends thereof to the central portion side in the longitudinal direction. The measurement was performed under an environment having a temperature of 23° C. and a relative humidity of 55% usingthe developing roller 16 which had been left to stand in an environment having a temperature of 23° C. and a relative humidity of 55% for 6 hours or more.

Next, the developing roller 16 which had been subjected to the measurement in advance as described above was incorporated into a cyan cartridge for a laser printer (trade name: "LBP7700C"; manufactured by Canon Inc.) so as to abut on its developing blade at the above-mentioned measurement position. The abutting pressure between the developing roller 16 and the developing blade was adjusted to 0.6 N/cm, to thereby change the settings so that deformation was more liable to occur than usual.

Next, the cartridge was left to stand in a high-temperature and high-humidity environment (temperature: 40° C., relative humidity: 95%) for 60 days. After that, the developing roller 16 was removed from the cartridge, and left to stand in an environment having a temperature of 23° C. and a relative humidity of 55% for 6 hours. After that, the distance from the center of the developing roller 16 to its surface was measured under an environment having a temperature of 23°

C. and a relative humidity of 55% in the same manner as before the abutment. The measurement was performed for each of the same three positions as the sites of the measurement before the standing under the high-temperature and high-humidity environment described above.

In each measurement position, a change between the distances from the center of the developing roller 16 to its surface before and after the abutment under the high-temperature and high-humidity environment in the developing blade abutting position was determined. The average value of the resultant changes in distance from the center of the developing roller 16 to its surface was defined as a residual deformation amount [μm].

(Evaluation of Set Image)

The developing roller which had undergone the measurement of its residual deformation amount described above was incorporated into a cyan cartridge of a laser printer (trade name: "LBP7700C"; manufactured by Canon Inc.) to produce a cartridge for an image output test.

The cartridge for an image output test was mounted onto the laser printer, and a halftone image was output. The resultant halftone image was evaluated in accordance with the following criteria. The period of time from the measurement of the residual deformation amount to the output of the halftone image was set to 1 hour.

A: A uniform image was obtained.

B: Extremely slight density unevenness due to the deformation of the developing roller was observed.

C: Density unevenness due to the deformation of the developing roller was observed in an end portion of the image or across the entire image.

TABLE 4

| | | Corresponding structural formula of ionic electroconductive agent or resin | | Evaluation result | | | |
|---|---|---|---|---|---|---|---|
| Example | Binder resin | Bonding site between cations | Cation moiety | Residual deformation amount (μm) | Set image | Roller resistance (Ω) | L/L ghost |
| 1 | EXCENOL | (1) | (A101) | 3 | A | 3.13E+06 | A |
| 2 | 500ED/ | (1) | (A102) | 4 | A | 3.59E+06 | A |
| 3 | B-1 | (2) | (A103) | 4 | A | 4.14E+06 | A |
| 4 | | (3) | (A103) | 3 | A | 3.89E+06 | A |
| 5 | | (4) | (A104) | 2 | A | 8.15E+05 | A |
| 6 | PTG- | (1) | (A105) | 2 | A | 3.99E+05 | A |
| 7 | L1000/ | (5) | (A105) | 4 | A | 4.13E+06 | A |
| 8 | B-1 | (6) | (A106) | 4 | A | 5.15E+06 | A |
| 9 | | (7) | (E101) | 2 | A | 3.89E+06 | A |
| 10 | | (7) | (E101) | 1 | A | 4.40E+06 | A |
| 11 | C-3090/ | (8) | (E102) | 2 | A | 3.33E+06 | A |
| 12 | B-2 | (9) | (E103) | 2 | A | 7.95E+05 | A |
| 13 | | (10) | (E103) | 2 | A | 3.69E+06 | A |
| 14 | | (7) | (E104) | 2 | A | 3.13E+06 | A |
| 15 | | (11) | (E104) | 2 | A | 9.10E+05 | A |
| 16 | | (7) | (E105) | 2 | A | 9.52E+06 | A |
| 17 | | (7) | (E105) | 1 | A | 2.20E+06 | A |
| 18 | | (12) | (E106) | 2 | A | 1.92E+06 | A |

TABLE 5

| | | | Evaluation result | | | |
|---|---|---|---|---|---|---|
| Comparative Example | Binder resin | Ionic electroconductive agent | Residual deformation amount (μm) | Set image | Roller resistance (Ω) | L/L ghost |
| 1 | EXCENOL | — | 2 | A | 8.15E+09 | C |
| 2 | 500ED/B-1 | Tributylmethylammonium bis(trifluoromethanesulfonyl)imide (manufactured by Tokyo Chemical Industry Co., Ltd.) | 8 | C | 5.64E+06 | A |
| 3 | | 1-Ethyl-3-methylimidazolium trifluoromethanesulfonate (manufactured by Tokyo Chemical Industry Co., Ltd.) | 6 | C | 3.64E+06 | A |
| 4 | | 1-Hexylpyridinium chloride (manufactured by Kanto Chemical Co., Inc.) | 9 | C | 5.66E+08 | C |

Each of the developing rollers according to Examples 1 to 18 contained, in its resin layer, a resin having a specific structure, and at least one anion selected from the group consisting of a fluoroalkylsulfonylimide anion and a fluorosulfonylimide anion, and hence had a small residual deformation amount and satisfactory image quality.

In contrast, each of the developing rollers according to Comparative Examples 2 to 4 not containing such structure had a high residual deformation amount and was found to cause density unevenness in an image. In addition, each of the developing roller according to Comparative Example 1 containing no ionic electroconductive agent, and the developing roller according to Comparative Example 4 containing, as the anion, none of the fluoroalkylsulfonylimide anion and the fluorosulfonylimide anion was found to have an increase in resistance of the developing roller and found to cause a ghost image.

«Production and Evaluation of Developing Blade»

EXAMPLE 19

As a substrate, an SUS sheet having a thickness of 0.08 mm (manufactured by Nisshin Steel Co., Ltd.) was press-cut so as to have dimensions of a length of 200 mm and a width of 23 mm. Next, as illustrated in FIG. 2, the cut. SUS sheet was immersed in the coating material for forming a resin layer of Example 1 to form a coating film of the coating material so as to have a length L from a longitudinal-side end of the cut SUS sheet of 1.5 mm, followed by drying. Further, the resultant was subjected to heating treatment at a temperature of 140° C. for 1 hour to form a resin layer having a thickness T of 10 μm on the longitudinal-side end surface of the SUS sheet. Thus, a developing blade according to Example 19 was produced.

EXAMPLE 20

A developing blade according to Example 20 was produced in the same manner as in Example 19 except that the coating material for forming a resin layer was changed to the coating material prepared in Example 4.

EXAMPLE 21

A developing blade according to Example 21 was produced in the same manner as in Example 19 except that the coating material for forming a resin layer was changed to the coating material prepared in Example 10.

EXAMPLE 22

A developing blade according to Example 22 was produced in the same manner as in Example 19 except that the coating material for forming a resin layer was changed to the coating material prepared in Example 15.

COMPARATIVE EXAMPLE 5

A developing blade according to Comparative Example 5 was produced in the same manner as in Example 19 except that the coating material for forming a resin layer was changed to the coating material prepared in Comparative Example 2.

COMPARATIVE EXAMPLE 6

A developing blade according to Comparative Example 6 was produced in the same manner as in Example 19 except that the coating material for forming a resin layer was changed to the coating material prepared in Comparative Example 4.

<Evaluation of Developing Blade>

The developing blades according to Examples 19 to 22 and Comparative Examples 5 and 6 were each evaluated for the following items. The evaluation results are shown in Table 6.

(Evaluation of Deformation Recoverability)

Figure 7:
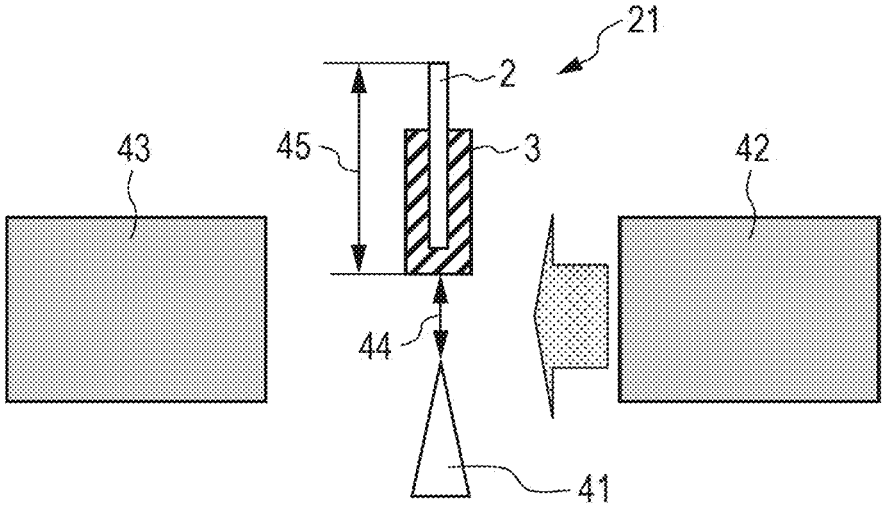
FIG. 7 is a schematic construction view of an apparatus for measuring the residual deformation amount of an electrophotographic blade.

Evaluation of deformation recoverability was performed using an apparatus illustrated in FIG. 7. This measurement apparatus includes: a holder (not shown) configured to fix the substrate 2; a reference plate 41; and a LED dimension-measuring machine (trade name: "LS-7000"; manufactured by Keyence Corporation) including a LED light-emitting part 42 and a light-receiving part 43.

First, a distance 45 from the end of the substrate 2 of the developing blade 21 on the side on which the resin layer 3 was not formed to the tip of the developing blade 21 on the resin layer 3 side was determined. The distance 45 was calculated by measuring the gap amount 44 between the tip of the developing blade 21 and the reference plate 41. The gap amount 44 between the tip of the developing blade 21 and the reference plate 41 was measured for each of the following three points in total: the central portion of the developing blade 21 in its longitudinal direction, and positions 20 mm away from both ends of the blade in the longitudinal direction to the central portion side in the longitudinal direction. The measurement was performed under an environment having a temperature of 23° C. and a relative humidity of 55% using the blade which had been left to stand in an environment having a temperature of 23° C. and a relative humidity of 55% for 6 hours or more.

Next, the developing blade 21 which had been subjected to the measurement in advance as described above was incorporated into a cyan cartridge for a laser printer (trade name: "LBP7700C"; manufactured by Canon Inc.) so that the tip of the developing blade abutted on the developing roller. The developing roller was changed to a roller made of a metal having a diameter of 12 m and the abutting pressure of the developing blade 21 was adjusted to 0.6 N/cm, to thereby change the settings so that deformation was more liable to occur than usual.

Next, the cartridge was left to stand in a high-temperature and high-humidity environment (temperature: 40° C., relative humidity: 95%) for 30 days. After that, the developing blade 21 was removed from the cartridge, and left to stand in an environment having a temperature of 23° C. and a relative humidity of 55% for 1 hour. After that, the distance 45 from the end of the developing blade 21 on the substrate 2 side to the tip of the developing blade 21 on the resin layer 3 side was measured under an environment having a temperature of 23° C. and a relative humidity of 55% in the same manner as before the abutment. The measurement was performed for each of the same three positions as the sites of the measurement before the standing under the high-temperature and high-humidity environment described above.

In each measurement position, a change between the distances 45 from the end of the developing blade 21 on the substrate 2 side to the tip of the developing blade 21 on the resin layer 3 side before and after the abutment under the high-temperature and high-humidity environment in the abutting position with the roller made of a metal was determined. The average value of the resultant changes in the distance 45 from the end of the developing blade 21 on the substrate 2 side to the tip of the developing blade 21 on the resin layer 3 side was defined as a residual deformation amount [μm].

(Evaluation of Image Density Difference)

The developing blade which had undergone the measurement of its residual deformation amount described above was incorporated into a cyan cartridge of a laser printer (trade name: "LBP7700C"; manufactured by Canon Inc.) to produce a cartridge for an image output test.

The cartridge for an image output test was mounted onto the laser printer, and a solid image was output to evaluate the resultant solid image. The period of time from the measurement of the residual deformation amount to the output of the solid image was set to 1 hour.

The density of the solid image was measured using a reflection densitometer (trade name: "GretagMacbeth RD918"; manufactured by GretagMacbeth) at each of arbitrary five points in a portion of the solid image corresponding to the central portion of the developing blade in its longitudinal direction, and arbitrary five points in a portion of the solid image corresponding to portions 3 cm away from both ends of the developing blade. The arithmetic average of the image densities of each of the central portion and the end portions was determined to determine the image density difference between the central portion and the end portions. Evaluation was performed using the determined image density difference by the following criteria.

A: The image density difference is less than 0.1.

B: The image density difference is from 0.1 or more to less than 0.3.

C: The image density difference is 0.3 or more.

TABLE 6

| | Binder resin | Corresponding structural formula of ionic electroconductive agent or resin: Bonding site between cations | Cation moiety | Evaluation result: Residual deformation amount (μm) | Difference in image density |
|---|---|---|---|---|---|
| Example 19 | EXCENOL | (1) | (A101) | 2 | A |
| Example 20 | 500ED/B-1 | (3) | (A103) | 1 | A |
| Example 21 | | (7) | (E101) | 1 | A |
| Example 22 | | (11) | (E104) | 1 | A |
| Comparative Example 5 | | Tributylmethylammonium bis(trifluoromethanesulfonyl)imide (manufactured by Tokyo Chemical Industry Co., Ltd.) | | 5 | C |
| Comparative Example 6 | | 1-Hexylpyridinium chloride (manufactured by Kanto Chemical Co., Inc.) | | 4 | C |

Each of the developing blades according to Examples 39 to 22 contained, in its resin layer, a resin having a specific structure, and at least one anion selected from the group consisting of a fluoroalkylsulfonylimide anion and a fluorosulfonylimide anion, and hence had a small residual deformation amount and satisfactory image quality.

In contrast, each of the developing blades according to Comparative Examples 5 and 6 not containing such structure had a high residual deformation amount and did not have satisfactory image quality.

«Production and Evaluation of Toner Feed Roller»

EXAMPLE 23

As the substrate 2, a cored bar made of stainless steel (SUS304) having a diameter of 5 mm was placed in a mold, and a urethane rubber composition obtained by mixing the following materials was injected into a cavity formed in the mold.

| | |
|---|---|
| Polyether polyol (trade name: "EP550N"; manufactured by Mitsui Chemical Industry Co., Ltd.) | 85.0 parts by mass |
| Isocyanate (trade name "COSMONATE TM20"; manufactured by Mitsui Chemical Industry Co., Ltd.) | 22.7 parts by mass |
| IP-1 as the compound (i) | 2.37 parts by mass |
| 1,2-Dimethylimidazole (manufactured by Tokyo Chemical Industry Co., Ltd.) as the compound (ii) | 0.63 part by mass |
| Silicone foam stabilizer (trade name "SRX274C"; manufactured by Dow Corning Toray Silicone Co., Ltd.) | 1.0 part by mass |
| Amine catalyst (trade name "TOYOCAT-ET"; manufactured by Tosoh Corporation) | 0.3 part by mass |
| Amine catalyst (trade name "TOYOCAT-L33"; manufactured by Tosoh Corporation) | 0.2 part by mass |
| Water | 2.0 parts by mass |

Subsequently, the mold was heated, and the urethane rubber composition was vulcanized at a temperature of 50° C. for 20 minutes to be foamed and cured. Thus, a polyurethane foam layer was formed on the peripheral surface of the substrate 2. After that, the substrate having the polyurethane foam layer formed thereon was removed from the mold. Thus, a toner feed roller having a polyurethane foam layer having a thickness of 6 mm formed on the outer periphery of the substrate 2 was produced.

EXAMPLES 24 to 27

Toner feed rollers according to Examples 24 to 27 were produced in the same manner as in Example 23 except that the compound (i) and the compound (ii), and their blending amounts were changed as shown in Table 7.

TABLE 7

| | Raw material compound | | | | |
|---|---|---|---|---|---|
| | Compound (i) | | Compound (ii) | | |
| | No. | part(s) by mass | No. | Compound name | part(s) by mass |
| Example 23 | IP-6 | 2.37 | CT-3 | 1,2-Dimethylamidazole (manufactured by Tokyo Chemical Industry Co., Ltd.) | 0.63 |
| Example 24 | IP-9 | 2.54 | CT-5 | 2-Methyl-5-ethyl-pyridine (manufactured by Tokyo Chemical Industry Co., Ltd.) | 0.46 |
| Example 25 | IP-3 | 2.02 | CT-10 | Triethanolamine (manufactured by Tokyo Chemical Industry Co., Ltd.) | 0.98 |
| Example 26 | IP-10 | 1.73 | CT-13 | Compound Z-2 (1,4-diglycidylimidazole) | 1.27 |
| Example 27 | IP-3 | 2.12 | CT-16 | 2-(2-Aminoethyl)-1-methylpyrrolidine (manufactured by Tokyo Chemical Industry Co., Ltd.) | 0.88 |

COMPARATIVE EXAMPLE 7

A toner feed roller according co Comparative Example 7 was produced in the same manner as in Example 23 except that 3.0 parts by mass of 1-ethyl-3-methylimidazolium trifluoromethanesulfonate (manufactured by Tokyo Chemical Industry Co., Ltd.) was added as an ionic electroconductive agent in place of the compound (i) and the compound (ii).

COMPARATIVE EXAMPLE 8

A toner feed roller according to Comparative Example 8 was produced in the same manner as in Comparative Example 7 except that 3.0 parts by mass of 1-hexylpyridinium chloride (manufactured by Kanto Chemical Co., Inc.) was used as an ionic electroconductive agent.

<Evaluation of Toner Feed Roller>

The toner feed rollers according to Examples 23 to 27 and Comparative Example 7 were each evaluated for the following items. The evaluation results are shown in Table 8.

(Evaluation of Deformation Recoverability)

The distance from the center of the toner feed roller to its surface was measured in the same manner as in the measurement method for the developing roller described above.

Next, the toner feed roller which had been subjected to the measurement in advance was incorporated into a cyan cartridge for a laser printer (trade name: "LBP7700C"; manufactured by Canon Inc.). The developing roller was changed to a roller made of a metal having a diameter of 12 mm and the diameter of the toner feed roller was set to 17 mm, which was larger than the diameter (16.1 mm) of the toner feed roller which had been mounted onto the laser printer, to thereby change the settings so that deformation was more liable to occur than usual.

Next, the cartridge was left to stand in a high-temperature and high-humidity environment (temperature: 40° C., relative humidity: 95%) for 60 days. After that, the toner feed roller was removed from the cartridge, and left to stand in an environment having a temperature of 23° C. and a relative humidity of 55% for 6 hours. After that, the distance from the center of the toner feed roller to its surface was measured under an environment having a temperature of 23° C. and a relative humidity of 55%. The measurement was performed for each of the same positions as the sites of the measurement before the standing under the high-temperature and high-humidity environment described above.

A change between the distances from the center of the toner feed roller to its surface before and after the standing under the high-temperature and high-humidity environment in the abutting position with the developing roller (residual deformation amount [μm]) was determined, and deformation recoverability was evaluated.

(Evaluation of Set Image)

The toner feed roller which had undergone the measurement of its residual deformation amount described above was incorporated into a cyan cartridge of a laser printer (trade name: "LBP7700C"; manufactured by Canon Inc.) to produce a cartridge for an image output test.

The cartridge for an image output test was mounted onto the laser printer, and a halftone image was output. The resultant halftone image was evaluated in accordance with the following criteria. The period of time from the measurement of the residual deformation amount to the output of the halftone image was set to 1 hour.

A: A uniform image was obtained.

B: Extremely slight density unevenness due to the deformation of the toner feed roller was observed.

C: Density unevenness due to the deformation of the toner feed roller was observed in an end portion of the image or across the entire image.

(Evaluation of Roller Resistance Value)

The resistance value of the toner feed roller was measured in the same manner as in the measurement of the resistance value of the developing roller described above. The load to be applied to both ends of the substrate 2 was set to 2.5 N, and the number of rotations of the roller during the measurement was set to 32 rpm. The measurement was performed under a low-temperature and low-humidity environment (temperature: 15° C., relative humidity: 10%) after the toner feed roller had been left to stand under the environment for 6 hours or more.

(Evaluation of L/L Ghost)

Next, the following evaluation was performed using the toner feed roller which had been subjected to the measurement of its resistance value under the low-temperature and low-humidity environment (temperature: 15° C., relative humidity: 10%) as described above.

The toner feed roller was mounted onto a laser printer having the construction illustrated in FIG. 3 (trade name:

"LBP7700C"; manufactured by Canon Inc.), and the laser printer was placed and left to stand for 2 hours under a low-temperature and low-humidity environment (temperature: 15° C., relative humidity: 10%). Then, evaluation of a ghost image was performed.

Specifically, as an image pattern, a 15 mm square solid black image was printed at a tip portion in one sheet by using a black toner, and then an entire halftone image was printed on the sheet by using the toner. Next, the density unevenness of the period of a toner feed roller appearing in a halftone portion was visually evaluated, and evaluation of a ghost was performed by the following criteria.

A: No ghost is observed.

B: An extremely slight ghost is observed.

C: A remarkable ghost is observed.

TABLE 8

| | Corresponding structural formula of ionic electro-conductive agent or resin | | Evaluation result | | | |
|---|---|---|---|---|---|---|
| | Bonding site between cations | Cation moiety | Residual deformation amount (μm) | Set image | Roller resistance (Ω) | L/L ghost |
| Example 23 | (2) | (A103) | 5 | A | 5.24E+06 | A |
| Example 24 | (4) | (A104) | 6 | A | 8.90E+06 | A |
| Example 25 | (7) | (E101) | 3 | A | 3.40E+06 | A |
| Example 26 | (10) | (E103) | 4 | A | 3.70E+05 | A |
| Example 27 | (7) | (E105) | 3 | A | 6.62E+06 | A |
| Comparative Example 7 | Tributylmethylammonium bis(trifluoromethanesulfonyl)imide (manufactured by Tokyo Chemical Industry Co., Ltd.) | | 18 | C | 2.20E+06 | A |
| Comparative Example 8 | 1-Hexylpryidinium chloride (manufactured by Kanto Chemical Co., Inc.) | | 22 | C | 2.80E+09 | C |

Each of the toner feed rollers according to Examples 23 to 27 contained, in its resin layer, a resin having a specific structure, and at least one anion selected from the group consisting of a fluoroalkylsulfonylimide anion and a fluorosulfonylimide anion, and hence had a small residual deformation amount and satisfactory image quality.

In contrast, each of the toner feed rollers according to Comparative Examples 7 and 8 not containing such structure had a high residual deformation amount and did not have satisfactory image quality. In addition, the toner feed roller according to Comparative Example 8 containing, as the anion, none of the fluoroalkylsulfonylimide anion and the fluorosulfonylimide anion was found to have an increase in resistance and found to cause a ghost image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 201.5-170584, filed Aug. 31, 2015, which is hereby incorporated by reference herein in its entirety.

What is claimed is:

1. An electrophotographic member, comprising:

an electroconductive substrate; and an electroconductive resin layer on the substrate, wherein the resin layer comprises a mixture of (i) a binder resin, (ii) an anion comprising at least one of a fluoroalkylsulfonylimide anion or a fluorosulfonylimide anion, and (iii) a cation selected from the group consisting of formulae (1) to (6)

$$A11\text{-}R101\text{-}A12 \quad (1)$$

where A11 and A12 independently represent any of formulae (A101) to (A106), and R101 represents a linking group having a straight chain moiety of 4 or more carbon atoms, the linking group making a distance corresponding to a straight chain of 4 or more carbon atoms between A11 and A12;

(2)

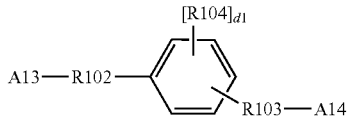

where A13 and A14 independently represent any of formulae (A101) to (A106), R102 and R103 independently represent a divalent hydrocarbon group having 1 to 4 carbon atoms, R104 represents a monovalent hydrocarbon group having 1 to 4 carbon atoms, and d1 represents an integer of 0 or 1;

(3)

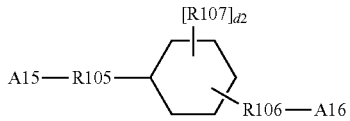

where A15 and A16 independently represent any of formulae (A101) to (A106), R105 and R106 independently represent a divalent hydrocarbon group having 1 to 4 carbon atoms, R107 represents a monovalent hydrocarbon group having 1 to 4 carbon atoms, and d2 represents an integer of 0 or 1;

$$A17\text{-}R108\text{-}(\text{-}O\text{—}R109\text{-})_{n1}A18 \quad (4)$$

where A17 and A18 independently represent any of formulae (A101) to (A106), n1 represents an integer of 1 to 4, and R108 and R109 constitute a part of a linking group for making a distance corresponding to a straight chain formed of at least 4 carbon atoms and 1 oxygen atom between A17 and A18, and independently represent a divalent hydrocarbon group having 2 to 4 carbon atoms;

(5)

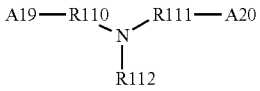

where A19 and A20 independently represent any of formulae (A101) to (A106), R112 represents a hydrogen atom, or a monovalent hydrocarbon group having 1 to 4 carbon atoms, and R110 and R111 constitute a part of linking group for binding A19 and A20, and independently represent a divalent hydrocarbon group having 2 to 4 carbon atoms, for making a distance corresponding to a straight chain of at least 2 carbon atoms between each of A19 and A20, and a nitrogen atom;

(6)

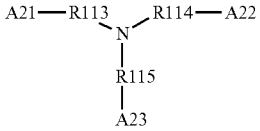

where A21 to A23 independently represent any of formulae (A101) to (A106), and R113 to R115 constitute a part of a linking group for binding A21 to A23, and independently represent a divalent hydrocarbon group having 2 to 4 carbon atoms, for making a distance corresponding to a straight chain of at least 2 carbon atoms between each of A21 to A23, and a nitrogen atom;

(A101)

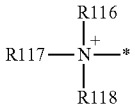

where R116 to R118 independently represent a monovalent hydrocarbon group having 1 to 12 carbon atoms, and symbol "*" represents a bonding site with any of formulae (1) to (6);

(A102)

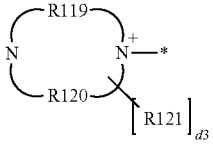

where R119 and R120 independently represent a hydrocarbon group needed for forming a nitrogen-containing heteroaromatic six-membered ring in formula (A102), R121's independently represent a monovalent hydrocarbon group having 1 to 12 carbon atoms, d3 represents an integer of from 0 to 2, and symbol "*" represents a bonding site with any of formulae (1) to (6);

(A103)

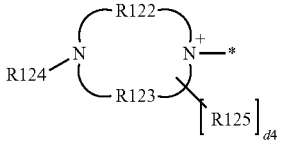

where R122 and R123 independently represent a hydrocarbon group needed for forming a nitrogen-containing heteroaromatic five-membered ring in formula (A103), R124 represents a hydrogen atom, or a monovalent hydrocarbon group having 1 to 12 carbon atoms, R125's independently represent a monovalent hydrocarbon group having 1 to 12 carbon atoms, d4 represents an integer of from 0 to 2, and symbol "*" represents a bonding site with any of formulae (1) to (6);

(A104)

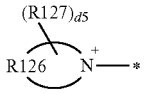

where R126 represents a hydrocarbon group needed for forming a nitrogen-containing heteroaromatic ring in formula (A104), R127's independently represent a monovalent hydrocarbon group having 1 to 12 carbon atoms, d5 represents an integer of from 0 to 2, and symbol "*" represents a bonding site with any of formulae (1) to (6);

(A105)

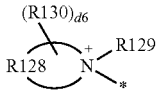

where R128 represents a hydrocarbon group needed for forming a nitrogen-containing heterocyclic nonaromatic ring in formula (A105), R129 represents a hydrogen atom, or a monovalent hydrocarbon group having 1 to 12 carbon atoms, R130's independently represent a monovalent hydrocarbon group having 1 to 12 carbon atoms, d6 represents an integer of from 0 to 2, and symbol "*" represents a bonding site with any of formulae (1) to (6); and (A106)

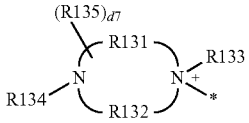

where R131 and R132 independently represent a hydrocarbon group needed for forming a nitrogen-containing heterocyclic nonaromatic ring in formula (A106), R133 and R134 independently represent a hydrogen atom, or a monovalent hydrocarbon group having 1 to 12 carbon atoms, R135's independently represent a monovalent hydrocarbon group having 1 to 12 carbon atoms, d7 represents an integer of from 0 to 2, and symbol "*" represents a bonding site with any of formulae (1) to (6).

2. The electrophotographic member according to claim 1, wherein the cation is represented by formula (1).

3. The electrophotographic member according to claim 2, wherein R101 in formula (1) has a straight chain moiety of 6 or more carbon atoms.

4. An electrophotographic member, comprising:

an electroconductive substrate; and an electroconductive resin layer on the substrate, wherein the resin layer contains (i) an anion comprising at least one of a fluoroalkylsulfonylimide anion or a fluorosulfonylimide anion, and (ii) a resin having a structure selected from the group consisting of formulae (7) to (12) in a molecule

E11-R201-E12 (7)

where E11and E12 independently represent any of formulae (E101) to (E106), and R201 represents a linking group having a straight chain moiety of 4 or more carbon atoms, the linking group making a distance corresponding to a straight chain of 4 or more carbon atoms between E11 and E12;

(8)

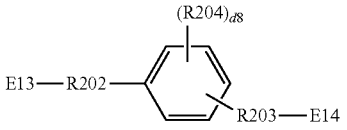

where E13 and E14 independently represent any of formulae (E101) to (E106), R202 and R203 independently represent a divalent hydrocarbon group having 1 to 4 carbon atoms, R204represents a monovalent hydrocarbon group having 1 to 4 carbon atoms, and d8 represents an integer of 0 or 1;

(9)

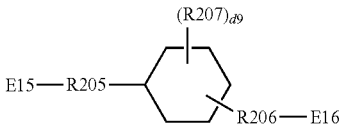

where E15 and E16 independently represent any of formulae (E101) to (E106), R205 and R206 independently represent a divalent hydrocarbon group having 1 to 4 carbon atoms, R207 represents a monovalent hydrocarbon group having 1 to 4 carbon atoms, and d9 represents an integer of 0 or 1;

(10)

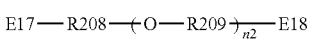

where E17 and E18 independently represent any of formulae (E101) to (E106), n2 represents an integer of 1 to 4 and R208 and R209 constitute a part of a linking group for making a distance corresponding to a straight chain formed of at least 4 carbon atoms and 1 oxygen atom between E17 and E18, and independently represent a divalent hydrocarbon group having 2 to 4 carbon atoms;

(11)

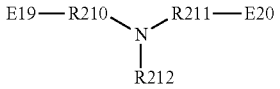

where E19 and E20 independently represent any of formulae (E101) to (E106), R212 represents a hydrogen atom, or a monovalent hydrocarbon group having 1 to 4 carbon atoms, and R210 and R211constitute a part of a linking group for binding E19 to E20, and independently represent a divalent hydrocarbon group having 2 to 4 carbon atoms, for making a distance corresponding to a straight chain of at least 2 carbon atoms between each of E19 and E20, and a nitrogen atom;

(12)

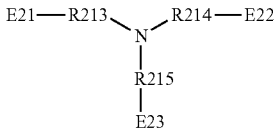

where E21 to E23 independently represent any of formulae (E101) to (E106), and R213 to R215 constitute a part of a linking group for binding E21 to E23, and independently represent a divalent hydrocarbon group having 2 to 4 carbon atoms, for making a distance corresponding to a straight chain of at least 2 carbon atoms between each of E21 to E23, and a nitrogen atom;

(E101)

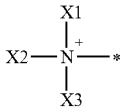

where X1 to X3 independently represent a monovalent hydrocarbon group having 1 to 12 carbon atoms, or a bonding site with the resin, at least one of X1 to X3 represents a bonding site with the resin, and symbol "*" represents a bonding site with any of formulae (7) to (12);

(E102)

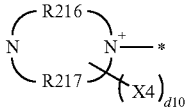

where R216 and R217 independently represent a hydrocarbon group needed for forming a nitrogen-containing heteroaromatic six-membered ring in formula (E102), X4's independently represent a monovalent hydrocarbon group having 1 to 12 carbon atoms, or a bonding site with the resin, d10 represents an integer of 1 or 2, at least one of X4's represents a bonding site with the resin, and symbol "*" represents a bonding site with any of formulae (7) to (12);

(E103)

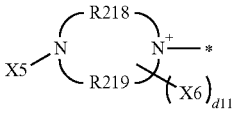

where R218 and R219 independently represent a hydrocarbon group needed for forming a nitrogen-containing heteroaromatic five-membered ring in formula (E103), X5 represents a hydrogen atom, a monovalent hydrocarbon group having 1 to 12 carbon atoms, or a bonding site with the resin, X6's independently represent a monovalent hydrocarbon group having 1 to 12 carbon atoms, or a bonding site with the resin, d11 represents an integer of from 0 to 2, at least one of X5 and X6's represents a bonding site with the resin, and symbol "*" represents a bonding site with any of formulae (7) to (12);

(E104)

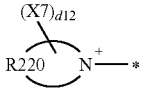

where R220 represents a hydrocarbon group needed for forming a nitrogen-containing heteroaromatic ring in formula (E104), X7's independently represent a monovalent hydrocarbon group having 1 to 12 carbon atoms, or a bonding site with the resin, d12 represents an integer of 1 or 2, at least one of X7's represents a bonding site with the resin, and symbol "*" represents a bonding site with any of formulae (7) to (12);

(E105)

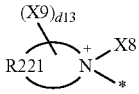

where R221 represents a hydrocarbon group needed for forming a nitrogen-containing heterocyclic nonaromatic ring in formula (E105), X8 represents a hydrogen atom, a monovalent hydrocarbon group having 1 to 12 carbon atoms, or a bonding site with the resin, X9's independently represent a monovalent hydrocarbon group having 1 to 12 carbon atoms, or a bonding site with the resin, d13 represents an integer of from 0 to 2, at least one of X8 and X9's represents a bonding site with the resin, and symbol "*" represents a bonding site with any of formulae (7) to (12); and (E106)

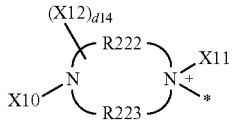

where R222 and R223 independently represent a hydrocarbon group needed for forming a nitrogen-containing heterocyclic nonaromatic ring in formula (E106), X10 and X11 independently represent a hydrogen atom, a monovalent hydrocarbon group having 1 to 12carbon atoms, or a bonding site with the resin, X12's independently represent a monovalent hydrocarbon group having 1 to 12 carbon atoms, or a bonding site with the resin, d14 represents an integer of from 0 to 2, at least one of X10 to X12's represents a bonding site with the resin, and symbol "*" represents a bonding site with any of formulae (7) to (12).

5. The electrophotographic member according to claim 4, wherein the bonding sites with the resin in X1 to X12's are independently selected from the group consisting of formulae (X101) to (X105):

(X101)

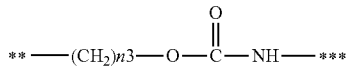

(X102)

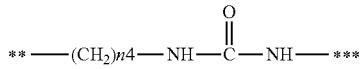

(X103)

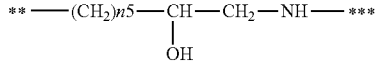

(X104)

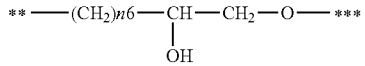

(X105)

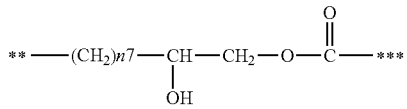

where symbol "* * " represents a bonding site with a nitrogen atom in formulae (E101), or represents a bonding site with one of a nitrogen atom in a nitrogen-containing heterocycle and a carbon atom in the nitrogen-containing heterocycle in any of formulae (E102) to (E106), symbol "***" represents a bonding site with a carbon atom in a polymer chain forming the resin, and n3 to n7 independently represent an integer of 1 to 4.

6. The electrophotographic member according to claim 4, wherein the resin has a structure represented by formula (7).

7. The electrophotographic member according to claim 6, wherein R101 in formula (1) has a straight chain moiety of 6 or more carbon atoms.

8. The electrophotographic member according to claim 4, wherein the nitrogen-containing heteroaromatic six-membered ring in formula (E102) is a pyrazine ring or a pyrimidine ring.

9. The electrophotographic member according to claim 4, wherein the nitrogen-containing heteroaromatic five-membered ring in formula (E103) is an imidazole ring.

10. The electrophotographic member according to claim 4, wherein the nitrogen-containing heteroaromatic ring in formula (E104) is a pyrrole ring, a pyridine ring, or an azepine ring.

11. The electrophotographic member according to claim 4, wherein the nitrogen-containing heterocyclic nonaromatic ring in formula (E105) is a pyrrolidine ring, a pyrroline ring, a piperidine ring, an azepane ring, or an azocane ring.

12. The electrophotographic member according to claim 4, wherein the nitrogen-containing heterocyclic nonaromatic ring in formula (E106) is an imidazolidine ring, an imidazoline ring, a piperazine ring, a diazepane ring, or a diazocane ring.

13. The electrophotographic member according to claim 4, wherein the anion comprises a fluoroalkylsulfonylimide anion having a fluoroalkyl group having 1 to 6 carbon atoms, a four-to seven-membered cyclic perfluoroalkyldisulfonylimide anion, or a fluorosulfonylimide anion.

14. A process cartridge, which is configured to be detachably attachable to a main body of an electrophotographic apparatus, the process cartridge comprising the electrophotographic member of claim 4.

15. An electrophotographic apparatus, comprising the electrophotographic member of claim 4.

* * * * *